US009283763B2

(12) United States Patent
Satake

(10) Patent No.: US 9,283,763 B2
(45) Date of Patent: Mar. 15, 2016

(54) RECORDING HEAD RECOVERY MECHANISM, INK-JET RECORDING APPARATUS THEREWITH, AND RECORDING HEAD RECOVERY METHOD

(71) Applicant: KYOCERA Document Solutions Inc., Osaka (JP)

(72) Inventor: Kenichi Satake, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/636,941

(22) Filed: Mar. 3, 2015

(65) Prior Publication Data

US 2015/0273837 A1 Oct. 1, 2015

(30) Foreign Application Priority Data

Mar. 25, 2014 (JP) ..... 2014-061597

(51) Int. Cl.
*B41J 2/165* (2006.01)

(52) U.S. Cl.
CPC ..... *B41J 2/16526* (2013.01); *B41J 2/16538* (2013.01); *B41J 2/16541* (2013.01); *B41J 2/16508* (2013.01)

(58) Field of Classification Search
CPC ..... B41J 2/16538; B41J 2/16544; B41J 2/16552; B41J 2/1652; B41J 2/16535
USPC ..... 347/33
See application file for complete search history.

(56) References Cited

U.S. PATENT DOCUMENTS

2013/0135385 A1* 5/2013 Kanzaki ..... 347/33

FOREIGN PATENT DOCUMENTS

JP 2013-49205 A 3/2013

* cited by examiner

*Primary Examiner* — Geoffrey Mruk
*Assistant Examiner* — Scott A Richmond
(74) *Attorney, Agent, or Firm* — Stein IP, LLC

(57) ABSTRACT

A recording head recovery mechanism has a wiper, a drive mechanism, and a controller. The controller can perform recording head recovery operation including a residual ink sticking step of letting residual ink at the tip of the wiper stick to a first position, and a wiping step of, after the residual ink sticking step, moving the wiper across an ink ejection surface from a second position, which is a position opposite from the nozzle region with respect to the first position, in a first direction toward the nozzle region to wipe off the residual ink along with purged ink.

13 Claims, 21 Drawing Sheets

RECORDING HEAD RECOVERY MECHANISM, INK-JET RECORDING APPARATUS THEREWITH, AND RECORDING HEAD RECOVERY METHOD

INCORPORATION BY REFERENCE

This application is based upon and claims the benefit of priority from the corresponding Japanese Patent Application No. 2014-061597 filed on Mar. 25, 2014, the entire contents of which are incorporated herein by reference.

BACKGROUND OF THE INVENTION

The present disclosure relates to an ink-jet recording apparatus that achieves recording by ejecting ink onto a recording medium such as paper. More particularly, the present disclosure relates to a recording head recovery mechanism that, after forcibly expelling ink out of an ejection nozzle of a recording head, wipes off the purged ink stuck on an ink ejection surface with a wiper.

Recording apparatuses such as facsimile machines, copiers, and printers are configured to record images on a recording medium such as paper or OHP sheets. The recording methods they adopt are classified into ink-jet, wire-dot, thermal, and other methods. Ink-jet recording methods further divide into a serial type, in which recording proceeds while a recording head scans across a recording medium, and a line-head type, in which recording is performed with a recording head fixed to an apparatus body.

For example, an ink-jet recording apparatus of the line-head type is provided with, for each color, an ink-jet head (recording head) which has ejection nozzles arrayed at predetermined intervals across the entire width of the printing region, the width being perpendicular to the direction of transport of the recording medium. As the recording medium is transported, ink is ejected from the ejection nozzles that correspond to the printing position, achieving printing over the entire recording medium.

In such ink-jet recording apparatuses, a recording head can exhibit degraded printing performance due to unstraight ink trajectory (skew flying), ink ejection failure, etc. One cause is considered to be an abnormal meniscus resulting from the soiling of the ink ejection surface of the recording head with deposits, like foreign matter such as dust and powder of paper produced as paper is transported; fine ink droplets (hereinafter referred to as mist) which are ejected together with ink droplets for image recording; and mist splashed back when ink droplets land on the recording medium. Other causes are considered to include degraded air-tightness with a cap fitted, resulting from mist depositing and becoming dry where the cap is fitted; and the resulting increase in the viscosity of ink inside the nozzles.

As a solution, with a view to preventing the drying of ink inside ink ejection nozzles which have apertures on the ink ejection surface of the recording head, and preventing the clogging of the ink ejection nozzles resulting from increased viscosity of ink inside them, a configuration is adopted where, first, ink is forcibly expelled (purged) out of nozzles and, then, the purged ink stuck on the ink ejection surface (nozzle surface) is wiped off with a blade-form wiper, thereby to perform recording head recovery operation.

For example, according to one known method, a wiper is put in contact, under a predetermined contact pressure, with a part of a recording head's ink ejection surface where it has no nozzles to wipe the ink ejection surface. Specifically, as shown in FIG. 36A, a wiper 103 is pressed against, substantially perpendicular to, an ink ejection surface 101*a* of a recording head 101, in a region (wiping start position) outside a nozzle region 102 where ink ejection nozzles are arranged. Next, as shown in FIGS. 36B and 36C, the wiper 103 is moved horizontally across the ink ejection surface 101*a* in the direction indicated by arrow A to wipe off ink 104 in the nozzle region 102. Then, as shown in FIG. 36D, the wiper 103 is moved off the ink ejection surface 101*a*, and is then moved horizontally in the direction indicated by arrow A' to return the wiper 103 to the wiping start position.

However, with the method shown in FIGS. 36A to 36D, when wiping is performed for the second time, ink 103*a* and 104*a* is stuck at the tip of the wiper 103 as shown in FIG. 37A. The ink 104*b* stuck at the tip of the wiper 103 has increased viscosity through exposure to air, and thus it then sticks to the ink ejection surface 101*a* as shown in FIGS. 37B and 37C.

On the other hand, in a known wiping mechanism for ink-jet recording apparatuses, two wipers are provided which can successively make contact with a recording head's ink ejection surface, the leading wiper wiping off purged ink, the following wiper wiping off ink left around the wiping start position of the leading wiper.

SUMMARY OF THE INVENTION

According to one aspect of the present disclosure, a recording head recovery mechanism is devised for recovery of a recording head having a nozzle region in which an ejection nozzle for ejecting ink onto a recording medium has an aperture. The recording head recovery mechanism includes a wiper, a drive mechanism, and a controller. The wiper wipes off purged ink forcibly expelled out of the ejection nozzle. The drive mechanism reciprocally moves the wiper across an ink ejection surface which includes the nozzle region. The controller can perform recovery operation for the recording head, and the recovery operation includes the following steps. In a residual ink sticking step, the wiper is put in pressed contact with a first position outside the nozzle region, and then the wiper is moved across the ink ejection surface to let residual ink at the tip of the wiper stick to the first position. In a wiping step, after the residual ink sticking step, the wiper is moved across the ink ejection surface from a second position, which is a position opposite from the nozzle region with respect to the first position, in a first direction toward the nozzle region to wipe off the residual ink and the purged ink. In an ink expelling step, before the wiper wipes off the purged ink, ink is forcibly expelled out of the ejection nozzle to let the purged ink stick to the nozzle region.

Further features and advantages of the present disclosure will become apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Hereinafter, embodiments of the present disclosure will be described with reference to the accompanying drawings.

First Embodiment

Figure 1:
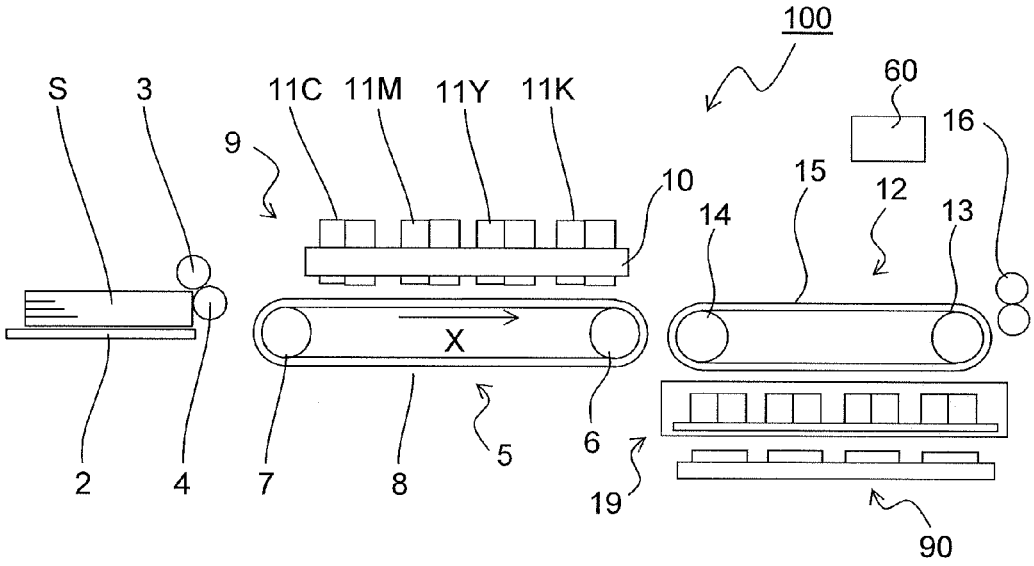
FIG. 1 is a side view showing an outline of a structure of an ink-jet recording apparatus according to a first embodiment of the present disclosure.

As shown in FIG. 1, in a left side part of an ink-jet recording apparatus 100 according to a first embodiment of the present disclosure, there is provided a sheet feed tray 2 for containing sheets S of paper (a recording medium). In one end part of the sheet feed tray 2, there are provided a sheet feed roller 3, which feeds the contained sheets S one by one, from the topmost sheet S, to a first transport unit 5 (described later); and a driven roller 4, which is kept in pressed contact with the sheet feed roller 3 so as to rotate together.

On the downstream side of the sheet feed roller 3 and the driven roller 4 with respect to the sheet transport direction (the direction indicated by arrow X), there are arranged a first transport unit 5 and a recording section 9. The first transport unit 5 includes a first driving roller 6, which is arranged on the downstream side with respect to the sheet transport direction; a first driven roller 7, which is arranged on the upstream side; and a first transport belt 8, which is wound around the first driving roller 6 and the first driven roller 7. As the first driving roller 6 is driven to rotate in the clockwise direction, a sheet S held on the first transport belt 8 is transported in the direction indicated by arrow X.

Here, owing to the first driving roller 6 being arranged on the downstream side with respect to the sheet transport direction, the transport surface (the top surface in FIG. 1) of the first transport belt 8 is pulled by the first driving roller 6. This helps increase the tension of the transport surface of the first transport belt 8, and allows stable transport of the sheet S. As the first transport belt 8, a sheet of a dielectric resin is used, and typically, a belt with no seam (seamless belt) is used.

Figure 2:
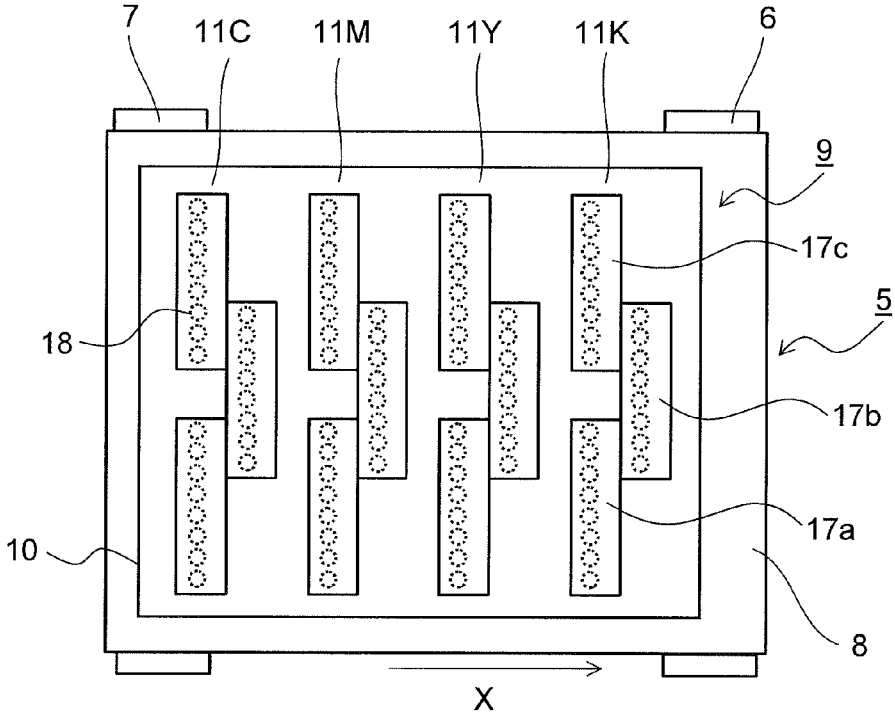
FIG. 2 is a plan view, as seen from above, of a first transport unit and a recording section in the ink-jet recording apparatus shown in FIG. 1.

The recording section 9 includes a head housing 10 and line heads 11C, 11M, 11Y, and 11K held on the head housing 10. These line heads 110 to 11K are supported at such a height as to leave a predetermined gap (e.g., 1 mm) from the transport surface of the first transport belt 8, and each have, as shown in FIG. 2, a plurality of (here, three) recording heads 17*a* to 17*c* arrayed in a staggered formation along the sheet width direction (the up/down direction in FIG. 2), which is perpendicular to the sheet transport direction. The line heads 110 to 11K have a recording region of which the width is larger than the maximum width of the sheet S that can be transported, and can eject ink from ink ejection nozzles 18 corresponding to the printing position onto a sheet S transported on the first transport belt 8.

Figure 3:
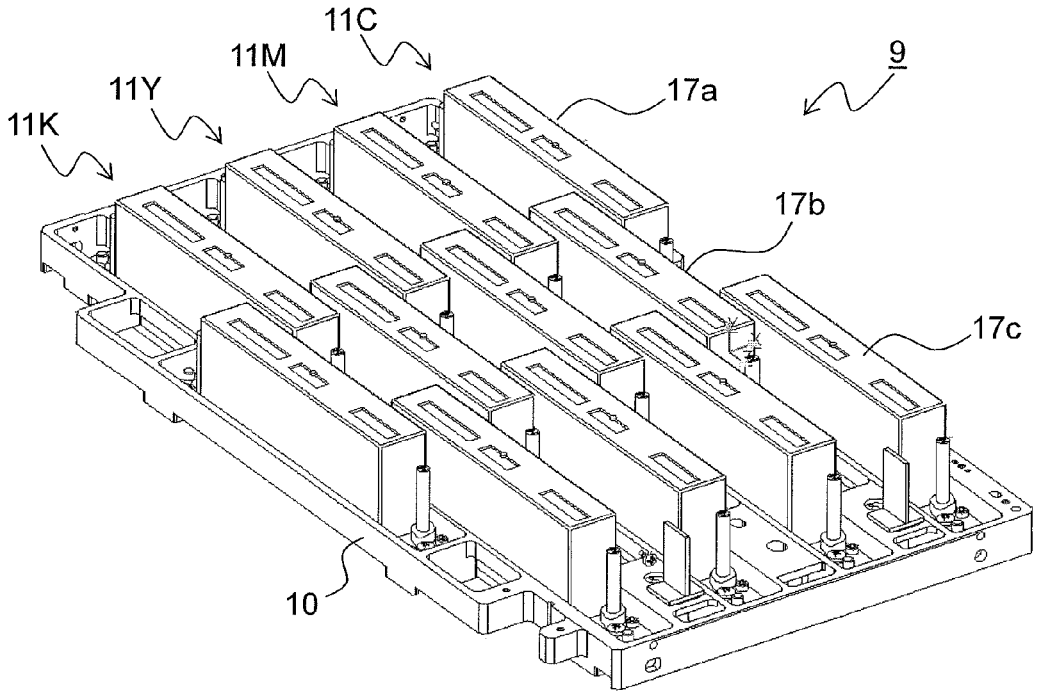
FIG. 3 is a perspective view, as seen from obliquely above, of the recording section.
Figure 4:
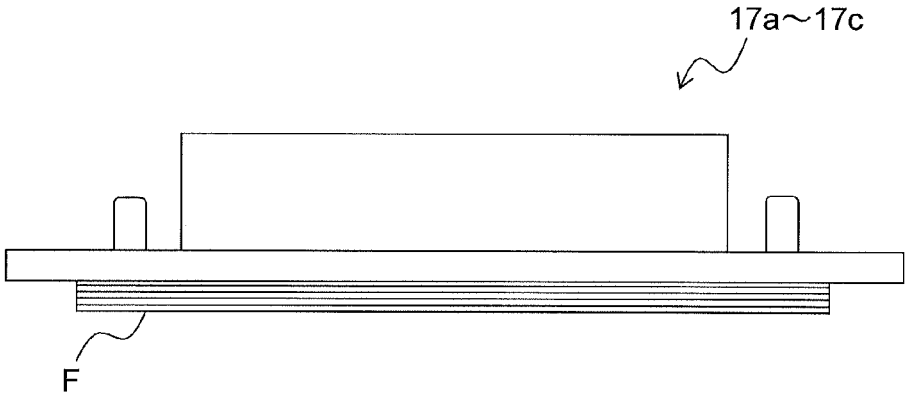
FIG. 4 is a side view of recording heads constituting line heads in the recording section.
Figure 5:
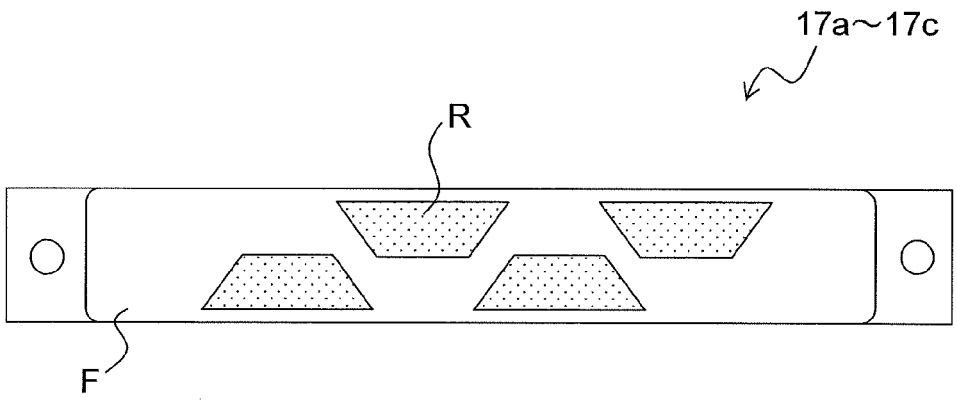
FIG. 5 is a plan view of the recording heads, as seen from an ink ejection surface side.

As shown in FIGS. 4 and 5, the recording heads 17*a* to 17*c* have, on their ink ejection surface, nozzle regions R in which a large number of ink ejection nozzles 18 are arrayed. As shown in FIGS. 2 and 3, the three recording heads 17*a* to 17*c* constituting each of the line heads 11C to 11K are arranged with overlaps between their end parts so that part of the ink ejection nozzles 18 provided in those recording heads 17*a* to 17*c* double in the sheet transport direction. FIG. 3 shows the recording section 9 as seen from behind what is shown in FIG. 1 (from above what is shown in FIG. 2), and thus the arrangement of the line heads 110 to 11K in FIG. 3 is reverse to that in FIGS. 1 and 2. The recording heads 17*a* to 17*c* have the same shape and the same structure, and therefore, in FIGS. 4 to 6, the recording heads 17*a* to 17*c* are represented by a single profile.

Figure 6:
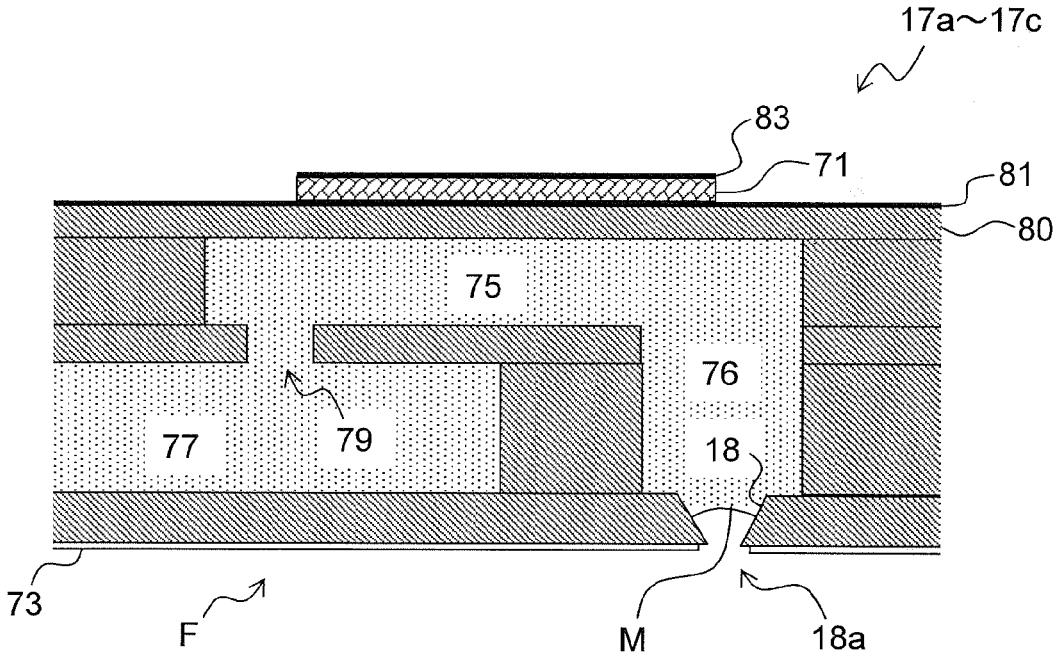
FIG. 6 is an enlarged sectional view showing a structure around an ink ejection nozzle in the recording head.

As shown in FIG. 6, in the ink ejection surface F of the recording heads 17*a* to 17*c*, a plurality of ejection ports 18*a* with a minute diameter are, as apertures of the ink ejection nozzles 18, provided at least over the maximum width of the printing region in the longitudinal direction (main scanning direction) of the ink ejection surface F.

The recording heads 17*a* to 17*c* include a water-repellent film 73, which covers the ink ejection surface F except over the ejection ports 18*a*; pressurizing chambers 75 provided one for each of the ejection ports 18*a*; nozzle passages 76, through which the pressurizing chambers 75 communicate with the corresponding ink ejection nozzles 18; and a common passage 77, through which ink is supplied from an ink tank 20 (see FIG. 7), where the ink is stored, to the plurality of pressurizing chambers 75. The pressurizing chambers 75 communicate with the common passage 77 via feed ports 79, through which ink is supplied from the common passage 77 to the pressurizing chambers 75. The ink ejection nozzles 18 are continuous from inside the pressurizing chambers 75 to the ejection ports 18*a*. Of the walls of the pressurizing chambers 7, the one on the side opposite from the ink ejection surface F is formed by a diaphragm 80. The diaphragm 80 is formed to be continuous over the plurality of pressurizing chambers 75, and is laid with a common electrode 81 which is likewise formed to be continuous over the plurality of pressurizing chambers 75. On the common electrode 81, piezoelectric elements 71 are provided one for each of the pressurizing chambers 75, and further on top, individual electrodes 83 are provided one for each of the pressurizing chambers 75 such that the piezoelectric elements 71 are held between the individual electrodes 83 and the common electrode 81.

Driving pulses generated by a driving pulse generator of a head driving section (unillustrated) are applied to the individual electrodes 83 such that the piezoelectric elements 71 are driven individually. The deformation of the piezoelectric elements 71 thus driven is transmitted to the diaphragm 80, which then itself deforms to compress the pressurizing chambers 75. As a result, a pressure acts on the ink inside the pressurizing chambers 75, and the ink passes through the nozzle passages 76 and the ink ejection nozzles 18 so as to be ejected, in the form of ink droplets, onto a sheet. Even when no ink is being ejected, ink is present inside the ink ejection nozzles 18, so that inside each ink ejection nozzle 18, ink forms a meniscus surface M.

Figure 7:
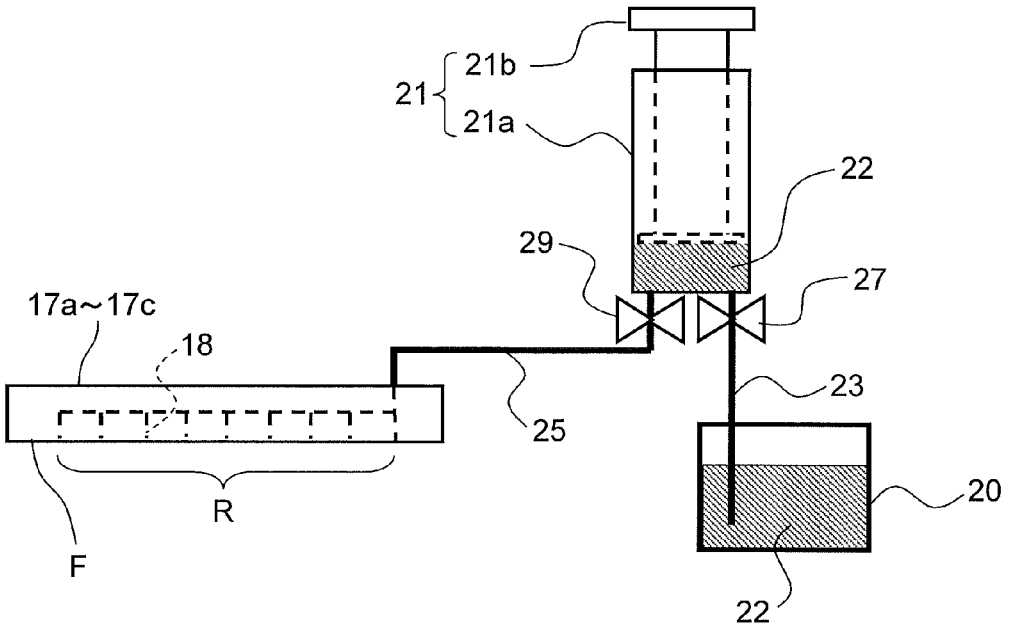
FIG. 7 is a diagram schematically showing ink passages from an ink tank to the recording heads in the ink-jet recording apparatus shown in FIG. 1.

The recording heads 17*a* to 17*c* constituting each of the line heads 110 to 11K are fed with ink of the corresponding one of four colors (cyan, magenta, yellow, and black) stored in the ink tank 20 (see FIG. 7).

According to image data received from an external computer or the like, the recording heads 17*a* to 17*c* eject ink through the ink ejection nozzles 18 onto a sheet S being attraction-held and transported on the transport surface of the first transport belt 8. As a result, a color image having ink of four colors, namely cyan, magenta, yellow, and black, superimposed on each other is formed on the sheet S on the first transport belt 8.

To prevent ink ejection failure due to drying-up or clogging in the recording heads 17*a* to 17*c*, purging is performed in preparation for subsequent printing by ejecting ink with increased viscosity out of, before starting printing after prolonged disuse, the ink ejection nozzles 18 of all the recording heads 17*a* to 17*c* and, at a pause between printing sessions, the ink ejection nozzles 18 of those recording heads 17*a* to 17*c* which have ejected less than a prescribed amount of ink.

As a method for ejecting ink from the recording heads 17*a* to 17*c*, any of various methods may be adopted, such as a piezoelectric method whereby ink is expelled by use of piezoelectric elements 71, or a thermal ink-jet method whereby ink is ejected under a pressure applied from bubbles produced by a heating member.

Back in FIG. 1, on the downstream side (the right side in FIG. 1) of the first transport unit 5 with respect to the sheet transport direction, there is arranged a second transport unit 12. The second transport unit 12 includes a second driving roller 13, which is arranged on the downstream side with respect to the sheet transport direction; a second driven roller 14, which is arranged on the upstream side; and a second transfer belt 15, which is wound around the second driving roller 13 and the second driven roller 14. As the second driving roller 13 is driven to rotate in the clockwise direction, a sheet S held on the second transfer belt 15 is transported in the direction indicated by arrow X.

A sheet S that has an ink image recorded on it in the recording section 9 is fed to the second transport unit 12, and while it passes through the second transport unit 12, the ink discharged onto the surface of the sheet S dries. Under the second transport unit 12, a maintenance unit 19 and a cap unit 90 are arranged. When the purging mentioned above is performed, the maintenance unit 19 moves to under the recording section 9; there, it wipes off the ink ejected from the ink ejection nozzles 18 of the recording heads 17*a* to 17*c* and collects the ink wiped off. When the ink ejection surface F (see FIG. 4) of the recording heads 17*a* to 17*c* needs to be capped, the cap unit 90 horizontally moves to under the recording section 9 and then moves upward to fit on the bottom surface of the recording heads 17*a* to 17*c*. The structure of the maintenance unit 19 will be described in detail later.

On the downstream side of the second transport unit 12 with respect to the sheet transport direction, there is provided a discharge roller pair 16 for discharging a sheet S having an image formed on it out of the apparatus body. On the downstream side of the discharge roller pair 16, there is provided a discharge tray (unillustrated) on which sheets S discharged out of the apparatus body are stacked.

Next, a description will be given of how ink is supplied from the ink tank 20 to the recording heads 17*a* to 17*c* during printing, and how ink is ejected from the recording heads 17*a* to 17*c* during purging. In practice, an ink passage as shown in FIG. 7 is provided between an ink tank 20 (see FIG. 7) for each color and the corresponding recording heads 17*a* to 17*c*; the following description, however, focuses on the ink passage for one arbitrary color.

As shown in FIG. 7, between the ink tank 20 and the recording heads 17*a* to 17*c*, a syringe pump 21 is arranged. The ink tank 20 and the syringe pump 21 are coupled together via a first feed passage 23 made of a tubular member, and the syringe pump 21 and a common passage 77 (see FIG. 6) in the recording heads 17*a* to 17*c* are coupled together via a second feed passage 25 made of a tubular member.

The first feed passage 23 is provided with an inflow valve 27, and the second feed passage 25 is provided with an outflow valve 29. Opening or closing the inflow valve 27 allows or inhibits ink movement through the first feed passage 23, and opening or closing the outflow valve 29 allows or inhibits ink movement through the second feed passage 25.

The syringe pump 21 is provided with a cylinder 21*a* and a piston 21*b*. The cylinder 21*a* is connected to the first feed passage 23 and to the second feed passage 25, and the ink 22 in the ink tank 20 flows into the cylinder 21*a* through the first feed passage 23. The ink is discharged from the cylinder 21*a* through the second feed passage 25, and the discharged ink is supplied to the recording heads 17*a* to 17*c* so as to be expelled through the ink ejection nozzles 18 into the nozzle region R on the ink ejection surface F.

The piston 21*b* is movable upward and downward by being driven by a driving device (unillustrated). A gasket (unillustrated) like an O-ring is fitted around the outer circumference of the piston 21*b*, and this prevents ink from leaking out of the cylinder 21*a* and also allows the piston 21*b* to slide smoothly along the inner circumferential surface of the cylinder 21*a*.

Normally (during printing), as shown in FIG. 7, the inflow valve 27 and the outflow valve 29 are both open, and the piston 21*b* is kept stationary at a prescribed position, so that a constant amount of ink is present inside the cylinder 21*a*. A surface tension (meniscus) between the cylinder 21*a* and the recording heads 17*a* to 17*c* causes the ink 22 to be supplied from the cylinder 21*a* to the recording heads 17*a* to 17*c*.

Figure 8:
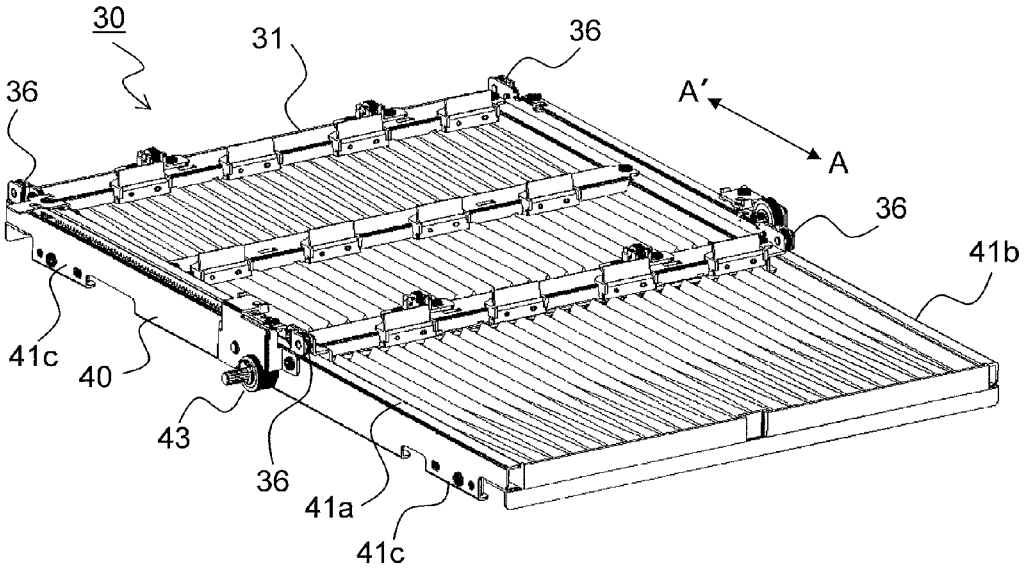
FIG. 8 is a perspective view, as seen from obliquely above, of a wiping mechanism provided in a maintenance unit.

The maintenance unit 19 is fitted with a wiping mechanism 30 as shown in FIG. 8. The wiping mechanism 30 is composed of a substantially rectangular carriage 31, to which a plurality of wipers 35*a* to 35*c* (see FIG. 9) are fixed; and a support frame 40, which supports the carriage 31. At opposite edges of the top face of the support frame 40, rails 41*a* and 41*b* are formed. Skating wheels 36 provided at the four corners of the carriage 31 abut on the rails 41*a* and 41*b*, so that the carriage 31 is supported on the support frame 40 so as to be slidable relative to it in the directions indicated by arrows A and A'.

Figure 9:
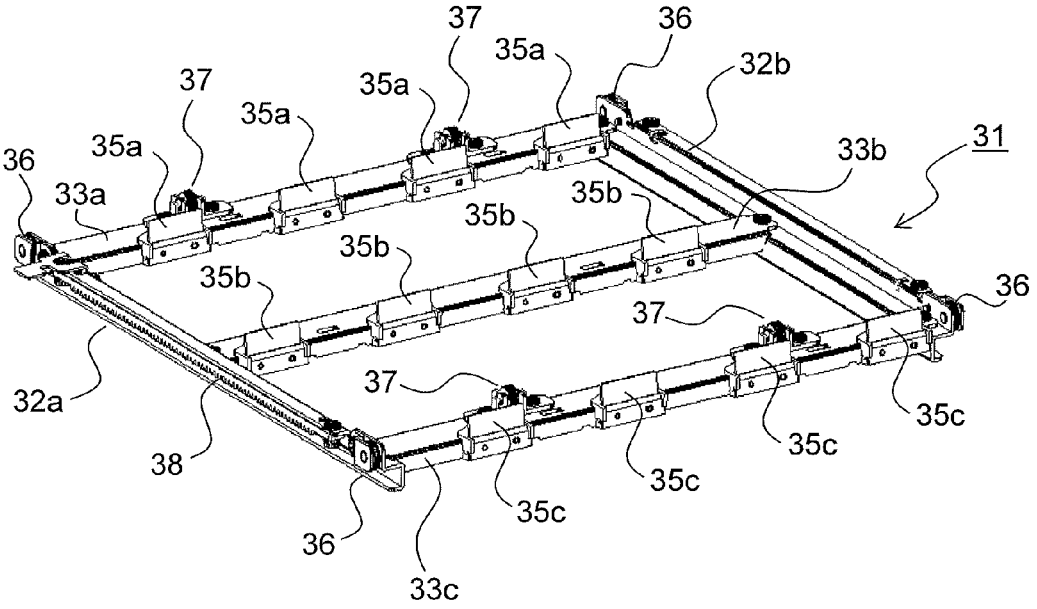
FIG. 9 is a perspective view, as seen from obliquely above, of a carriage included in the wiping mechanism.

As shown in FIG. 9, the carriage 31 is formed in a frame shape composed of first stays 32*a* and 32*b*, which slidably engage with the rails 41*a* and 41*b* via the skating wheels 36; and second stays 33*a*, 33*b*, and 33*c*, which are fixed to the first stays 32*a* and 32*b* so as to bridge between them.

On the first stay 32*a*, rack cogs 38 are formed that mesh with an input gear 43 (see FIG. 8) held on the support frame 40. As the input gear 43 rotates in the forward and reverse directions, the carriage 31 moves reciprocally in the horizontal direction (the directions indicated by arrows A and A' in FIG. 8) along the support frame 40. The rack cogs 38, the input gear 43, and an ascending/descending mechanism 50 (described later) constitute a drive mechanism according to the present disclosure.

The wipers 35*a* to 35*c* are members for wiping off ink ejected from the ink ejection nozzles 18 of the recording heads 17*a* to 17*c*. The wipers 35*a* to 35*c* are put in pressed contact from a substantially perpendicular direction at a position outside the nozzle region R (see FIG. 5) where the nozzle surface of the ink ejection nozzles 18 is exposed, and as the carriage 31 moves, the wipers 35*a* to 35*c* wipe the ink ejection surface F including the nozzle region R in a predetermined direction (the direction indicated by arrow A in FIG. 8, a first direction).

The second stay 33*a* has four wipers 35*a* fixed to it at substantially equal intervals; likewise the second stay 33*b* has four wipers 35*b*, and the second stay 33*c* has four wipers 35*c*, fixed to them respectively at equal intervals. The wipers 35*a* and 35*c* are arranged respectively at positions corresponding to the left and right recording heads 17*a* and 17*c* (see FIG. 3) constituting the line heads 11C to 11K. The wipers 35*b* are arranged at positions corresponding to the central recording heads 17*b* (see FIG. 3) constituting the line heads 11C to 11K, and are fixed at positions deviated by a predetermined distance from those of the wipers 35*a* and 35*c* in the direction perpendicular to the movement direction (the directions indicated by arrows A and A' in FIG. 8) of the carriage 31.

At four places on the top face of each of the second stays 33*a* and 33*c*, gap wheels 37 are provided. When the wiping mechanism 30 is raised toward the recording section 9 to wipe the ink ejection surface F of the recording heads 17*a* to 17*c* with the wipers 35*a* to 35*c*, the gap wheels 37 abut on the head housing 10 of the recording section 9 to maintain steady contact between the wipers 35*a* to 35*c* and the ink ejection surface F.

Figure 10:
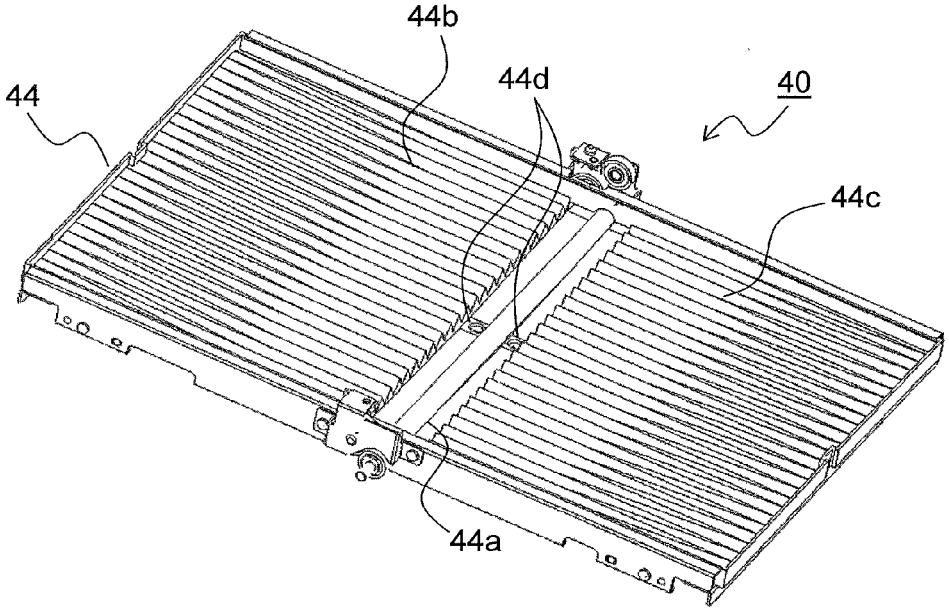
FIG. 10 is a perspective view, as seen from obliquely above, of a support frame included in the wiping mechanism.

As shown in FIG. 10, on the top face of the support frame 40, there is arranged an ink collection tray 44 for collecting waste ink wiped off from the ink ejection surface F by the wipers 35*a* to 35*c*. In a substantially central part of the ink collection tray 44, a groove 44*a* is formed along the direction in which the second stays 33*a* to 33*c* extend, and the tray surfaces 44*b* and 44*c* on opposite sides of the groove 44*a* across it has a downward slope toward the groove 44*a*. In the groove 44*a*, ink discharge ports 44*d* are provided, and the floor surface of the groove 44*a* has a downward slope toward the discharge ports 44*d*.

The waste ink wiped off the ink ejection surface F by the wipers 35*a* to 35*c* drops onto the tray surfaces 44*b* and 44*c* to be gathered in the groove 44*a*, and continues to flow inside the groove 44*a* toward the ink discharge ports 44*d*. The waste ink is then collected in a waste ink collection tank (unillustrated) through an ink collection passage (unillustrated) coupled to the ink discharge ports 44*d*.

Figure 11:
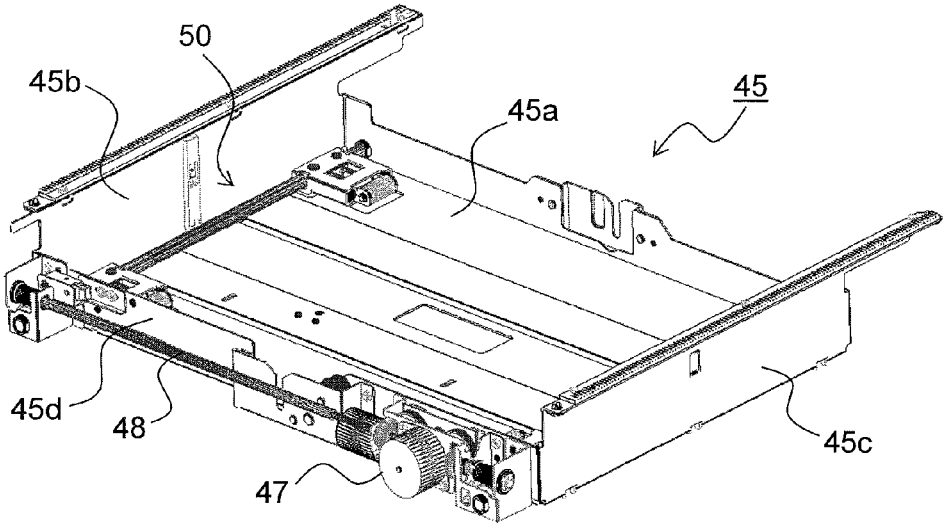
FIG. 11 is an exterior perspective view showing a unit housing of the maintenance unit, with the wiping mechanism removed.
Figure 12:
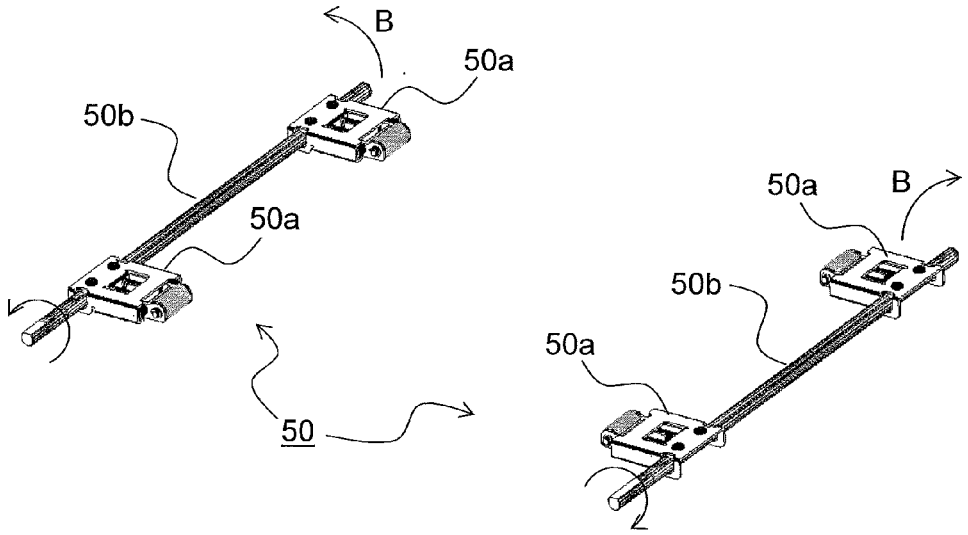
FIG. 12 is a perspective view of ascending/descending mechanisms arranged in a unit housing, with lift members in a horizontal state.

Next, a description will be given of an ascending/descending mechanism 50 for ascending and descending the wiping mechanism 30 according to this embodiment. The maintenance unit 19 includes a unit housing 45 as shown in FIG. 11, a wiping mechanism 30 (see FIG. 8) which is fitted to the unit housing 45, and an ascending/descending mechanism 50 which is arranged in the unit housing 45. As shown in FIGS. 11 and 12, on the floor face 45*a* of the unit housing 45, there is arranged a pair of ascending/descending mechanisms 50, each having two lift members 50*a* fixed to opposite ends of a shaft 50*b*, along opposite side faces 45*b* and 45*c* of the unit housing 45 in the movement direction (the directions indicated by arrows A and A' in FIG. 8) of the carriage 31. That is, the ascending/descending mechanisms 50 are arranged at positions facing opposite ends of the head housing 10 of the recording section 9 in the width direction (the upper and lower ends in FIG. 2). In FIG. 11, the side face 45*c* side ascending/descending mechanism 50 is omitted from illustration. On a side face 45*d* of the unit housing 45 contiguous with the side faces 45*b* and 45*c*, there are fitted a motor 47 and a drive transmission shaft 48, the latter transmitting the rotating drive force of the former to the shaft 50*b*.

Figure 14:
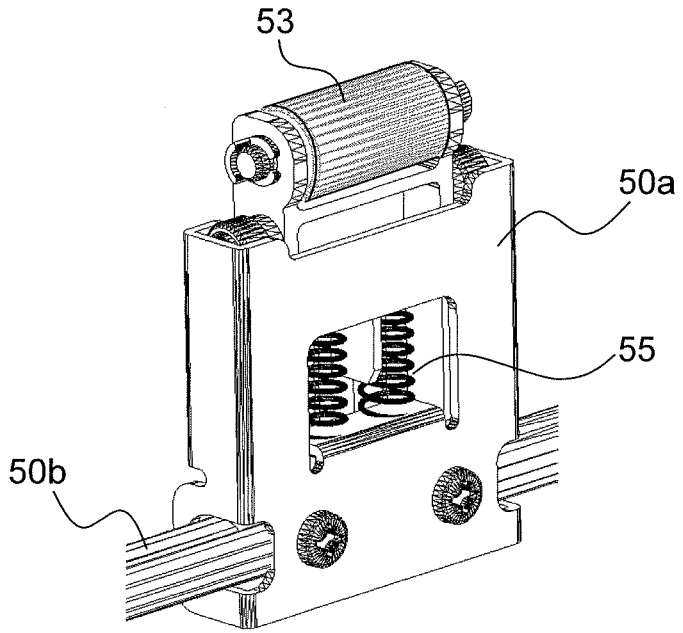
FIG. 14 is a perspective view of the lift member included in the ascending/descending mechanism.

As shown in FIG. 14, a bottom end part of the lift member 50*a* is fixed to the shaft 50*b*, and as the shaft 50*b* rotates, the lift member 50*a* swings. In an upper end part of the lift member 50*a*, a lift wheel 53 is rotatably fitted. The lift wheel 53 engages with an engagement portion 41*c* (see FIG. 8) formed in a bottom end part of the support frame 40, and is movable by rotating along the engagement portion 41*c*. Thus, the friction between the support frame 40 and the lift member 50*a* during the operation of the ascending/descending mechanism 50 is reduced by the rotation of the lift wheel 53, and this permits smooth ascending and descending operation by the ascending/descending mechanism 50. The lift wheel 53 is biased by a coil spring 55 in a direction (the upward direction in FIG. 14) away from the shaft 50*b*.

From the state shown in FIG. 12, rotating the shaft 50*b* of the right-hand ascending/descending mechanism 50 in the clockwise direction and the shaft 50*b* of the left-hand ascending/descending mechanism 50 in the counter-clockwise direction causes the lift members 50*a*, which have thus been lying flat inward of the unit housing 45, to rise outward (in the direction indicated by arrows B), and the lift wheels 53 move to the outward ends of the engagement portions 41*c*. Thus, the lift members 50*a* are switched from a horizontal state to an upright state (the state shown in FIG. 13), and thereby lift up the carriage 31 along with the support frame 40.

Figure 13:
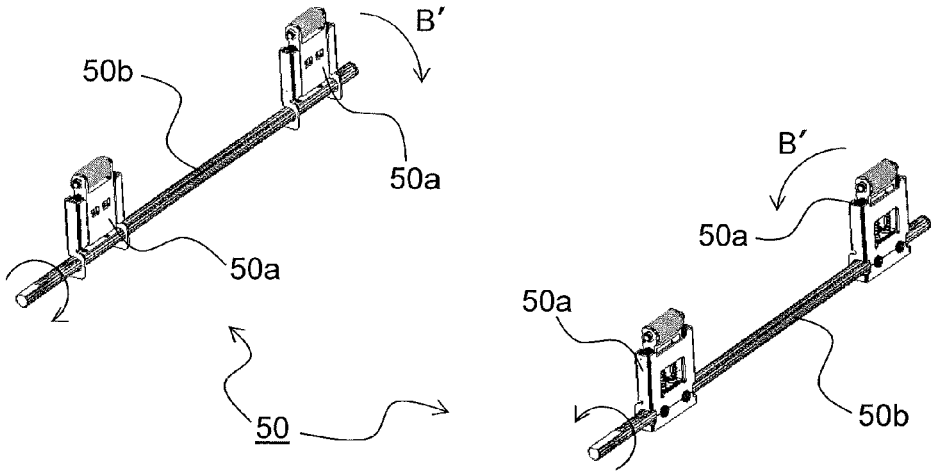
FIG. 13 is a perspective view of the ascending/descending mechanisms arranged in the unit housing, with the lift members in an upright state.

On the other hand, from the state shown in FIG. 13, rotating the shaft 50*b* of the right-hand ascending/descending mechanism 50 in the counter-clockwise direction and the shaft 50*b* of the left-hand ascending/descending mechanism 50 in the clockwise direction causes the lift members 50*a* to lie flat inward (in the direction indicated by arrows B') of the unit housing 45, and the lift wheels 53 move to the inward ends of the engagement portions 41*c*. Thus, the lift members 50*a* are switched from an upright state to a horizontal state (the state shown in FIG. 12), and thereby lower the carriage 31 along with the support frame 40.

Next, a description will be given of recovery operation for the recording heads 17*a* to 17*c* which is performed by use of the wiping mechanism 30 in the ink-jet recording apparatus 100 of this embodiment. FIGS. 16 to 18, 20 to 23, 25, and 26 all show the recording section 9 and the maintenance unit 19 as seen from the downstream side (the left side in FIG. 15) with respect to the sheet transport direction. For the sake of simple illustration, the support frame 40 is illustrated as a plate, and of the unit housing 45, only the bottom face 45*a* is shown.

Figure 15:
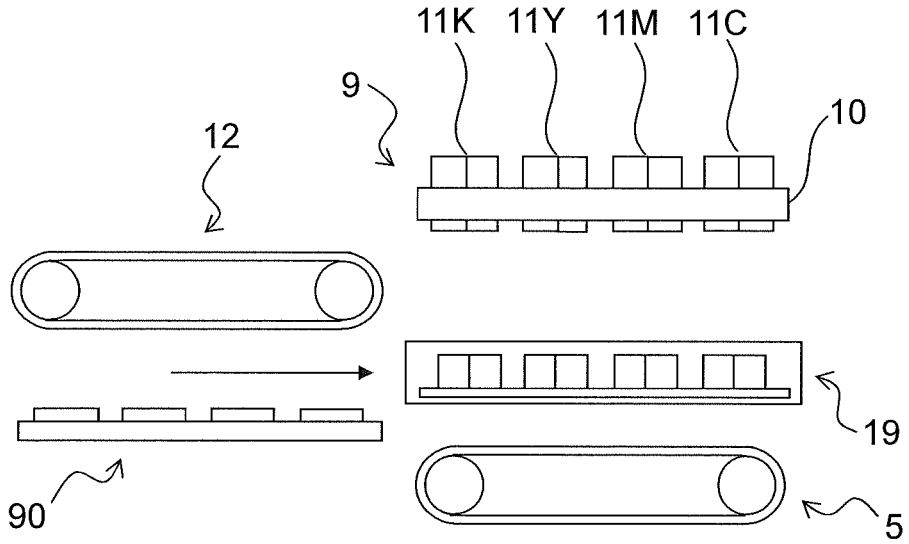
FIG. 15 is a side view showing the maintenance unit positioned below the recording section.
Figure 16:
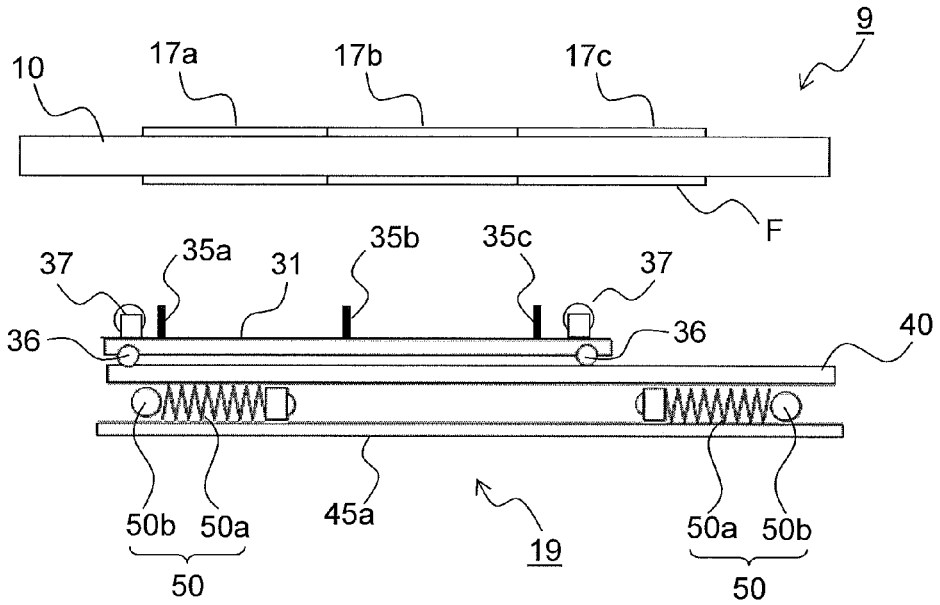
FIG. 16 is a side view showing the carriage, the wipers, the support frame, and the ascending/descending mechanisms inside the maintenance unit in the state shown in FIG. 15.

In preparation for recovery operation for the recording heads 17*a* to 17*c*, first, as shown in FIG. 15, a controller 60 (see FIG. 1) lowers the first transport unit 5, which is located under the recording section 9. Then the controller 60 moves the maintenance unit 19, which is located under the second transport unit 12, horizontally to between the recording section 9 and the first transport unit 5. In this state, as shown in FIG. 16, the lift members 50*a* of the ascending/descending mechanisms 50 are in a horizontal state, and the wipers 35*a* to 35*c* fixed to the carriage 31 are located away from the ink ejection surface F.

Figure 17:
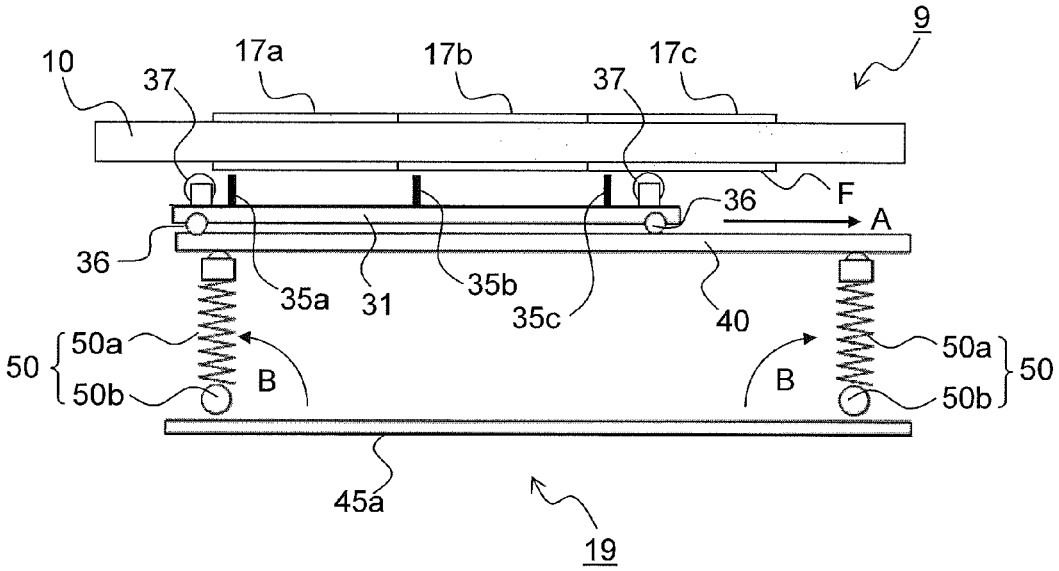
FIG. 17 is a side view showing, as a result of the ascending/descending mechanisms raising the support frame and the carriage from the state shown in FIG. 16, the wipers positioned at a predetermined gap from the ink ejection surface.
Figure 18:
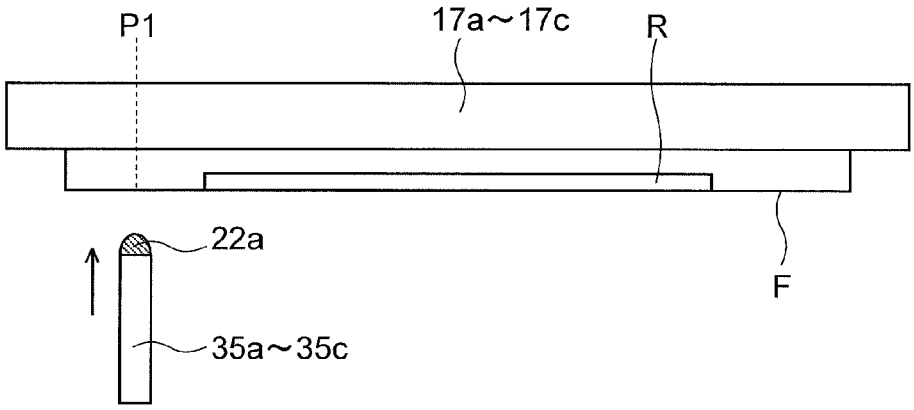
FIG. 18 is a side view of the recording heads with the wipers positioned under a first position.
Figure 19:
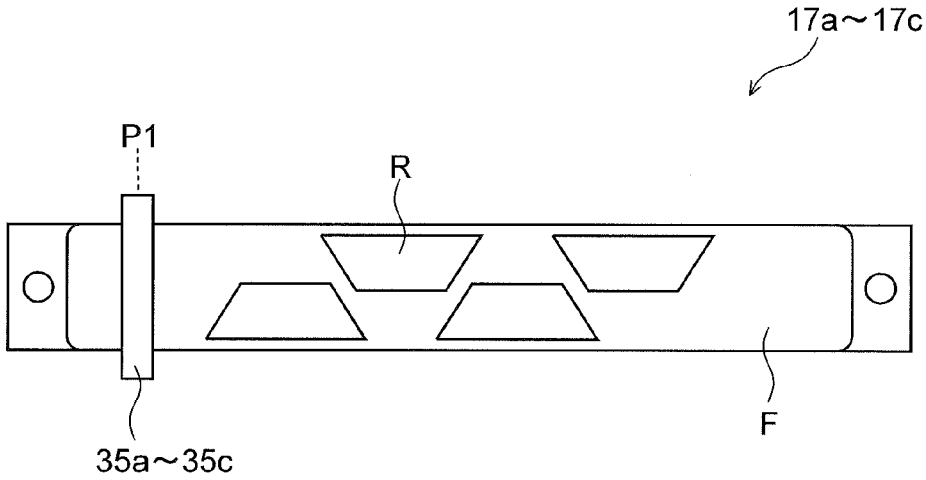
FIG. 19 is a plan view of the recording heads in the state shown in FIG. 18, as seen from the ink ejection surface side.

Residual Ink Sticking Step:

The wipers 35*a* to 35*c* are put into contact, under a predetermined pressure, with a first position P1 outside the nozzle region R on the ink ejection surface F of the recording heads 17*a* to 17*c*. Specifically, as shown in FIGS. 17 to 19, the controller 60 controls a drive mechanism to rotate the shafts 50*b* of the ascending/descending mechanisms 50 to raise the lift members 50*a* in the direction indicated by arrows B, and thereby lifts up the support frame 40 and the carriage 31. Here, the biasing force of the coil springs 55 (see FIG. 14) of the lift members 50*a* presses the gap wheels 37 provided on the carriage 31 against the bottom face of the head housing 10, and this allows the wipers 35*a* to 35*c* to be kept in pressed contact with the ink ejection surface F under a constant pressure.

Figure 20:
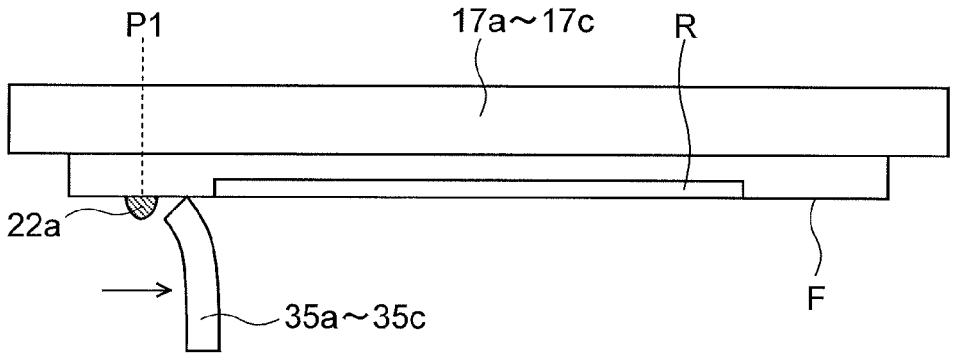
FIG. 20 is a side view of the recording heads with the wipers moved in a first direction in pressed contact with the ink ejection surface.

From the state where the wipers 35*a* to 35*c* are at their tips in pressed contact with the ink ejection surface F, the controller 60 controls the drive mechanism to rotate the input gear 43 (see FIG. 8) in the forward direction to move the carriage 31 in the direction indicated by arrow A in FIG. 17, and thereby moves the wipers 35*a* to 35*c* supported on the carriage 31 in the direction of the nozzle region R (the rightward direction, the first direction) across the ink ejection surface F as shown in FIG. 20. Since the support frame 40 is being acted on by an upward force from the ascending/descending mechanisms 50, the carriage 31 moves in the direction indicated by arrow A with the gap wheels 37 pressed against the head housing 10.

Now, as shown in FIG. 20, residual ink 22*a*, i.e., ink that was left at the tips (upper ends) of the wipers 35*a* to 35*c* after previous recording head recovery operation and has come to have increased viscosity through prolonged contact with air, sticks to the first position P1 on the ink ejection surface F and comes off the tips of the wipers 35*a* to 35*c*. Then the controller 60 controls the drive mechanism to stop the rightward movement before the tips of the wipers 35*a* to 35*c* enter the nozzle region R.

Figure 21:
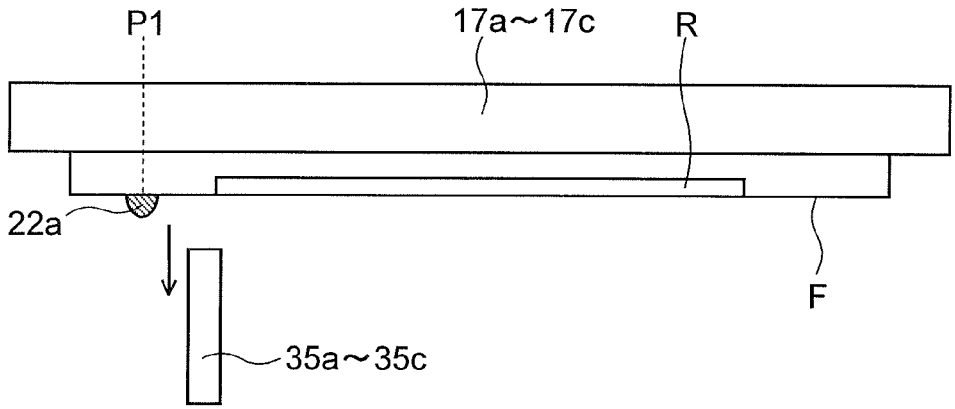
FIG. 21 is a side view of the recording heads with the wipers moved, from the state shown in FIG. 20, off the ink ejection surface.

Moving Step:

After the residual ink sticking step, the controller 60 controls the drive mechanism to move the wipers 35*a* to 35*c* off the ink ejection surface F as shown in FIG. 21. Specifically, the controller 60 controls so as to rotate the shafts 50*b* (see FIG. 17) of the ascending/descending mechanisms 50 in the reverse direction to swing the lift members 50*a* in the direction opposite to the direction indicated by arrows B into a horizontal state, and thereby lowers the support frame 40 and the carriage 31.

Figure 22:
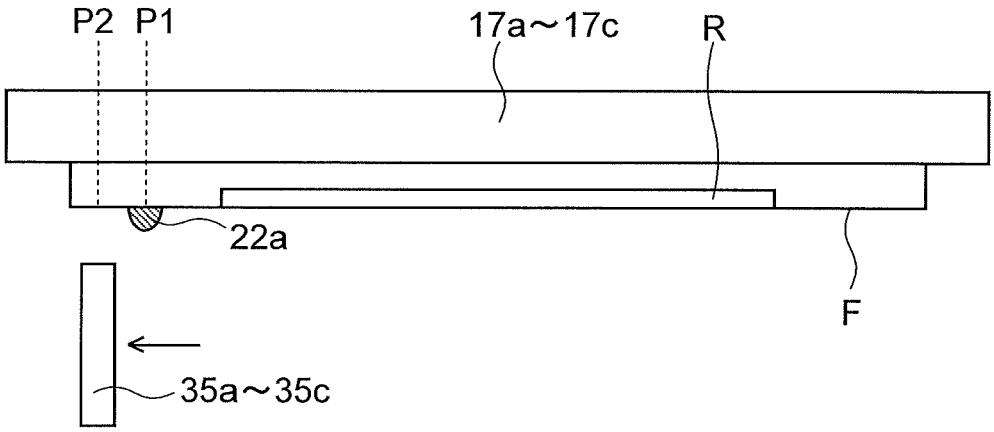
FIG. 22 is a side view of the recording heads with the wipers moved, from the state shown in FIG. 21, to under a second position.

Thereafter, as shown in FIG. 22, the controller 60 controls the drive mechanism to move the wipers 35*a* to 35*c* horizontally in the direction away from the nozzle regions R. Specifically, from the state shown in FIG. 21, the controller 60 rotates the input gear 43 (see FIG. 8) in the reverse direction to move the carriage 31 in the direction (the direction indicated by arrow A') opposite to the direction indicated by arrow A in FIG. 17, so that, as shown in FIG. 22, the wipers 35*a* to 35*c* supported on the carriage 31 move in the direction (the leftward direction, a second direction) away from the nozzle regions R with respect to the first positions P1. When the wipers 35*a* to 35*c* reach somewhere close to an end parts of the ink ejection surfaces F, the leftward movement is stopped.

Figure 23:
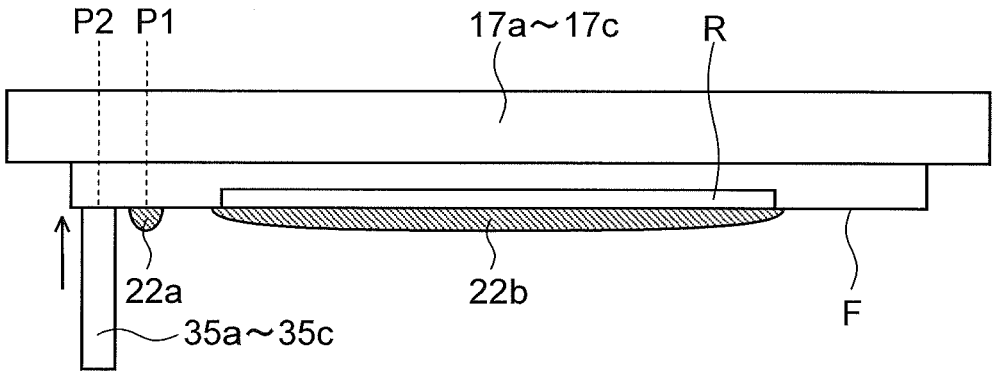
FIG. 23 is a side view of the recording heads with the wipers put into contact with the ink ejection surface and with ink forcibly expelled (purged)

Ink Expelling Step:

Prior to wiping (a wiping step, described later), as shown in FIG. 23, the controller 60 controls the drive mechanism to put the wipers 35*a* to 35*c* into contact, under a predetermined pressure, with second positions P2 outward of the first positions P1 on the ink ejection surfaces F (the second position P2 thus being a position opposite from the nozzle region R with respect to the first position P1). Specifically, as shown in FIG. 17, the controller 60 so controls as to rotate the shafts 50*b* of the ascending/descending mechanisms 50 to raise the lift members 50*a* in the direction indicated by arrows B, and thereby lifts up the support frame 40 and the carriage 31.

Figure 24:
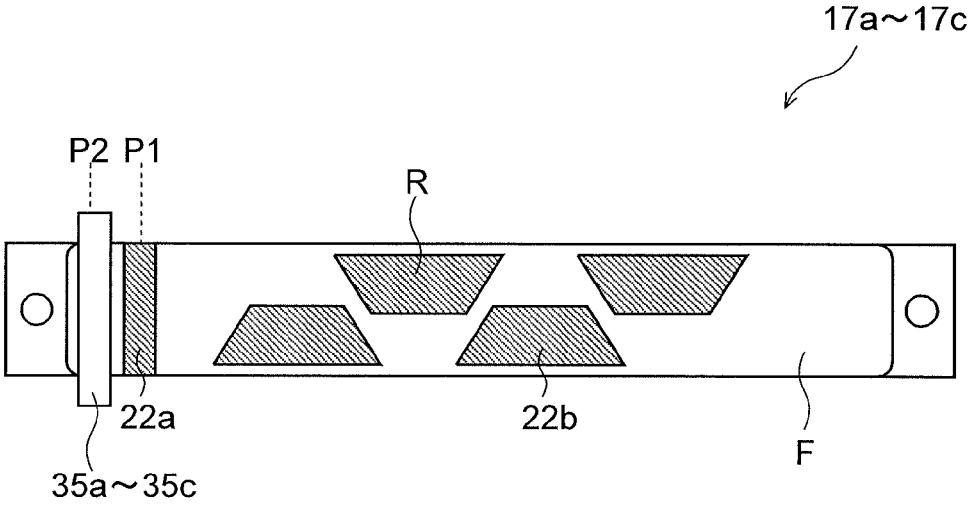
FIG. 24 is a plan view of the recording heads in the state shown in FIG. 23, as shown from the ink ejection surface side.

Next, the controller 60 closes the inflow valves 27 (see FIG. 7), and pressurizes the syringe pumps 21 (see FIG. 7), so that the ink 22 inside the cylinders 21*a* is supplied to the recording heads 17*a* to 17*c* through the second feed passages 25. The supplied ink 22 is forcibly expelled (purged) out of the ink ejection nozzles 18. As a result of this purging, ink with increased viscosity, foreign matter, and bubbles inside the ink ejection nozzles 18 are discharged out of the ink ejection nozzles 18, and thus recovery of the recording heads 17*a* to 17*c* is achieved. Here, as shown in FIG. 24, the purged ink 22*b* is expelled to over the ink ejection surfaces F in the shape of the nozzle region R where the ink ejection nozzles 18 are provided.

Figure 25:
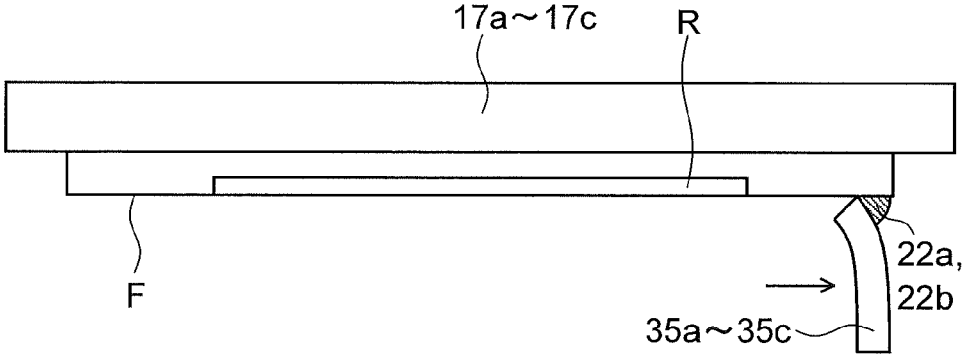
FIG. 25 is a side view of the recording heads with the wipers moved, from the state shown in FIG. 23, to a downstream-side edge in the first direction.

Ink Wiping Step:

Thereafter, wiping is performed to wipe off the purged ink 22*b* forcibly expelled to over the ink ejection surfaces F. Specifically, the controller 60 controls the drive mechanism to rotate the input gear 43 (see FIG. 8) in the forward direction from the state in FIGS. 23 and 24 to move the carriage 31 in the direction indicated by arrow A in FIG. 17, so that, as shown in FIG. 25, the wipers 35*a* to 35*c* supported on the carriage 31 move in the direction of the nozzle region R (the rightward direction) across the ink ejection surfaces F while being kept in pressed contact with the ink ejection surfaces F. Since the support frame 40 is being acted on by an upward force from the ascending/descending mechanisms 50, the carriage 31 moves in the direction indicated by arrow A with the gap wheels 37 pressed against the head housing 10, and the residual ink 22*a* and the purged ink 22*b* on the ink ejection surfaces F is wiped off. The waste ink wiped off by the wipers 35*a* to 35*c* is collected in the ink collection tray 44 (see FIG. 10).

Figure 26:
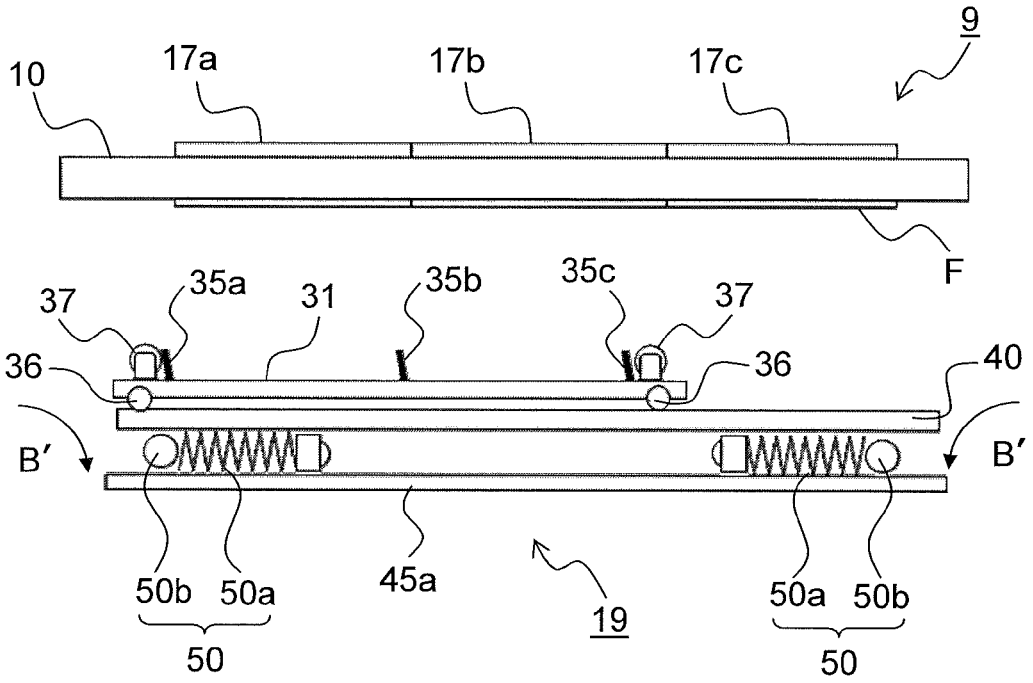
FIG. 26 is a side view of, as a result of the ascending/descending mechanisms lowering the support frame and the carriage, with the wipers moved off the ink ejection surface.

After the wipers 35*a* to 35*c* have moved to edges (the right edge in FIG. 25) of the ink ejection surfaces F of the recording heads 17*a* to 17*c* respectively, as shown in FIG. 26, the controller 60 controls the drive mechanism to rotate the shafts 50*b* of the ascending/descending mechanisms 50 to lay down the lift members 50*a* in the direction indicated by arrows B', and thereby retracts the wipers 35*a* to 35*c* downward off the ink ejection surfaces F of the recording heads 17*a* to 17*c* to return the maintenance unit 19 to the state shown in FIG. 16. Lastly, the controller 60 so controls as to move the maintenance unit 19, which is positioned between the recording section 9 and the first transport unit 5, horizontally to under the second transport unit 12, and to raise the first transport unit 5 to a predetermined position. Thus, the recovery operation for the recording heads 17*a* to 17*c* is completed.

In a case where the recording heads 17*a* to 17*c* are to be fitted with the cap unit 90, first, as shown in FIG. 15, the controller 60 lowers the first transport unit 5, which is located opposite the bottom face of the recording section 9. Then the controller 60 moves the cap unit 90, which is located under the second transport unit 12, horizontally to between the recording section 9 and the first transport unit 5 into a position opposite the recording section 9.

Next, the controller 60 raises the first transport unit 5 and thereby lifts up the cap unit 90. When the cap unit 90 comes in close contact with the recording heads 17*a* to 17*c*, the controller 60 stops raising the first transport unit 5. Thus, the fitting of the cap unit 90 is completed.

In this embodiment, as described above, first the residual ink sticking step is performed to let the residual ink 22*a* at the tips of the wipers 35*a* to 35*c* stick to the first positions P1, and then the wiping step is performed to move the wipers 35*a* to 35*c* from the second positions P2, which is the positions opposite from the nozzle regions R with respect to the first positions P1, in the directions of the nozzle regions R (the first direction) across the ink ejection surfaces F; thereby the residual ink 22*a* and the purged ink 22*b* is wiped off by the wipers 35*a* to 35*c*. This helps suppress deposition of the residual ink 22*a* on the ink ejection surfaces F, and thus helps suppress formation of a large pool of ink. Moreover, unlike a structure provided with two wipers that successively make contact with an ink ejection surface (the structure of the conventional wiping mechanism provided with two wipers discussed earlier), it is possible to suppress an increase in the number of wipers 35*a* to 35*c*, and thus to suppress complication of the structure of the mechanism for recovery of the recording heads 17*a* to 17*c*.

Moreover, as described above, the ink expelling step is performed after the residual ink sticking step. Thus, in the residual ink sticking step, when the wipers 35*a* to 35*c* are moved across the ink ejection surfaces F, no purged ink 22*b* sticks to the wipers 35*a* to 35*c*. Thus, it is possible to suppress sticking of ink 22 to the second positions P2 in the wiping step.

Moreover, as described above, in the residual ink sticking step, the wipers 35*a* to 35*c* are moved so as not to enter the nozzle regions R. Thus, even when the ink expelling step is performed before the residual ink sticking step, it is possible to suppress sticking of the purged ink 22*b* to the wipers 35*a* to 35*c* in the residual ink sticking step.

Moreover, as described above, in the residual ink sticking step, the wipers 35*a* to 35*c* are moved from the first positions P1 in the first direction, and after the residual ink sticking step, the wipers 35*a* to 35*c* are moved off the ink ejection surfaces F, and are then moved in the second direction to under the second positions P2, and then the wiping step is performed. This makes it easy to perform recovery operation for the recording heads 17*a* to 17*c*.

Second Embodiment

A second embodiment of the present disclosure deals with a configuration which makes the residual ink 22*a* stuck to the ink ejection surfaces F easier to wipe off. The second embodiment adopts a structure similar to that in the first embodiment described previously, and therefore no description of the structure itself will be repeated. Also, those aspects of recovery operation for the recording heads 17*a* to 17*c* here which are similar to those in the first embodiment will be discussed only briefly.

In preparation for recovery operation for the recording heads 17*a* to 17*c*, first, as shown in FIG. 15, the controller 60 lowers the first transport unit 5, and moves the maintenance unit 19 horizontally to place it between the recording section 9 and the first transport unit 5.

Figure 27:
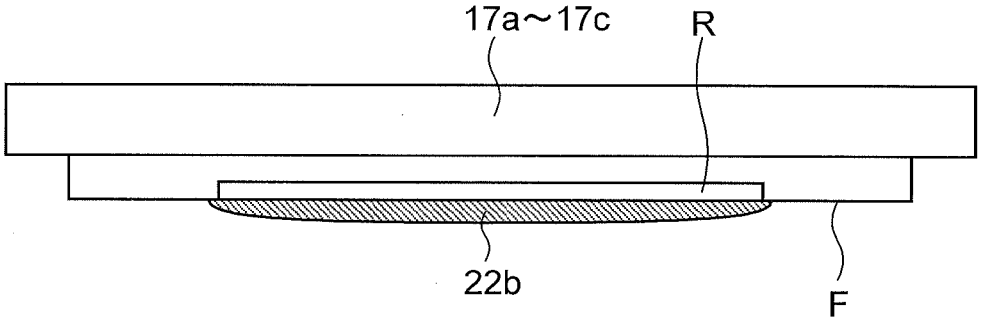
FIG. 27 is a diagram illustrating recording head recovery operation in a second embodiment of the present disclosure, being a side view of recording heads with ink forcibly expelled (purged)

Ink Expelling Step:

In this embodiment, an ink expelling step is performed before a residual ink sticking step. The controller 60 closes the inflow valves 27 (see FIG. 7), and pressurizes the syringe pumps 21 (see FIG. 7). This causes the ink 22 inside the cylinders 21*a* to be supplied to the recording heads 17*a* to 17*c* through the second feed passages 25. The supplied ink 22 is forcibly expelled (purged) out of the ink ejection nozzles 18. As a result, as shown in FIG. 27, purged ink 22*b* sticks to the ink ejection surfaces F.

Figure 28:
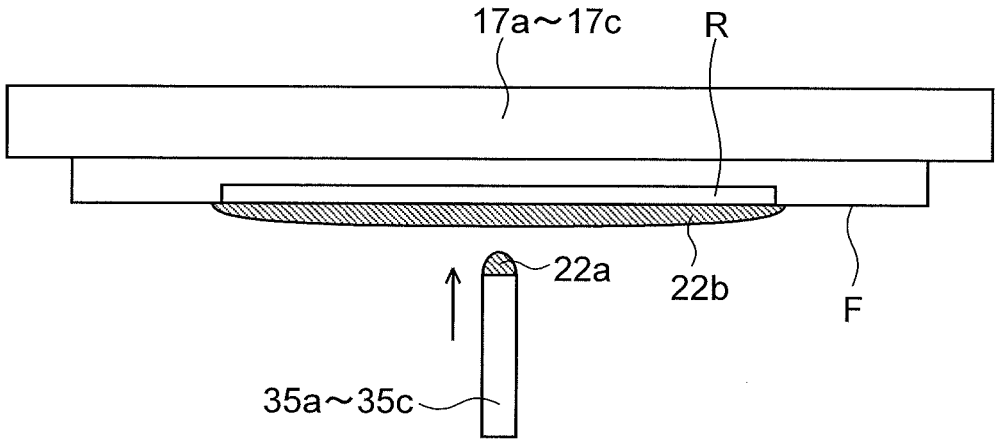
FIG. 28 is a side view of the recording heads with the wipers moved, from the state shown in FIG. 27, to under purged ink.
Figure 29:
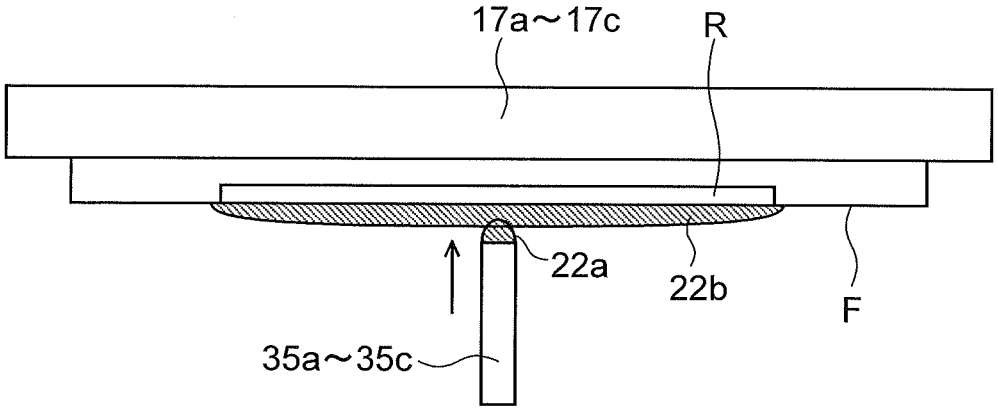
FIG. 29 is a side view of the recording heads with the wipers raised, from the state in FIG. 28, into contact with purged ink.

Purged Ink Contacting Step:

Next, as shown in FIG. 28, the controller 60 controls the drive mechanism to move the wipers 35*a* to 35*c* to under the nozzle regions R on the ink ejection surfaces F of the recording heads 17*a* to 17*c*. The controller 60 then controls the drive mechanism to drive the ascending/descending mechanisms 50 such that, as shown in FIG. 29, the residual ink 22*a* at the tips of the wipers 35*a* to 35*c* comes into contact with the purged ink 22*b*. Here, it is preferable that the residual ink 22*a* make contact with the purged ink 22*b* without making contact with the ink ejection surfaces F. As a result of the residual ink 22*a* coming into contact with the purged ink 22*b*, the residual ink 22*a* dissolves, lowering the viscosity of the residual ink 22*a*. The positioning of the recording heads 17*a* to 17*c* in the height direction can be achieved by use of a sensor or the like.

Figure 30:
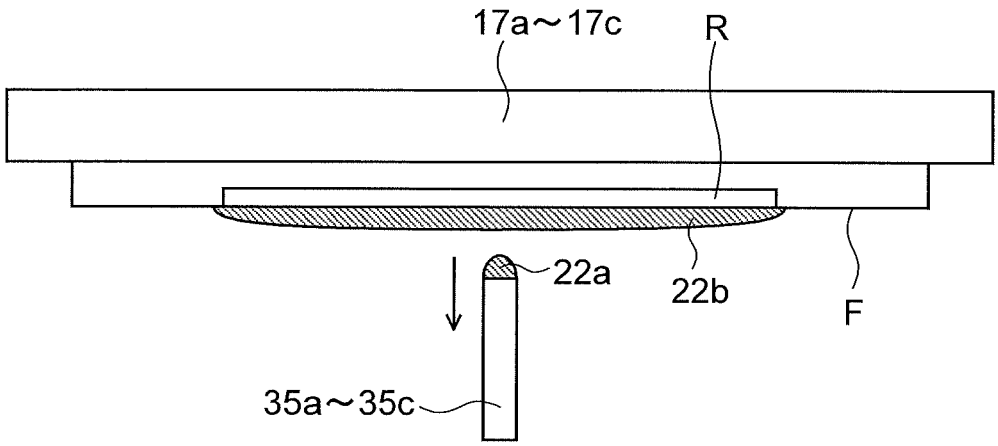
FIG. 30 is a side view of the recording head with the wipers lowered, from the state in FIG. 29, off the purged ink.

Thereafter, the controller 60 controls the drive mechanism to drive the ascending/descending mechanisms 50 such that, as shown in FIG. 30, the wipers 35*a* to 35*c* moves off the ink ejection surfaces F.

Figure 31:
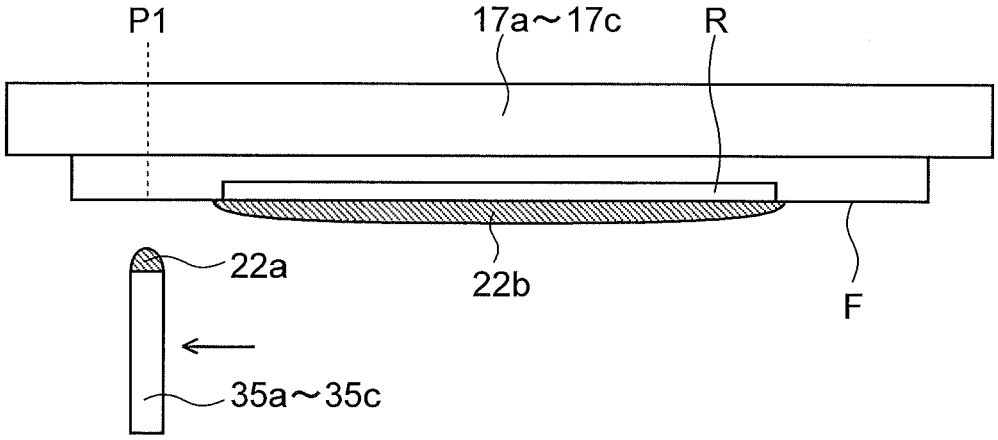
FIG. 31 is a side view of recording heads 17*a* to 17*c* with wipers 35*a* to 35*c* moved, from the state in FIG. 30, to under a first position P1.

Residual Ink Sticking Step:

The controller 60 controls the drive mechanism to move the wipers 35*a* to 35*c* to under first positions P1 on the ink ejection surfaces F of the recording heads 17*a* to 17*c* as shown in FIG. 31, and then drives the ascending/descending mechanisms 50 to put the wipers 35*a* to 35*c* into contact with the first positions P1 under a predetermined pressure.

Figure 32:
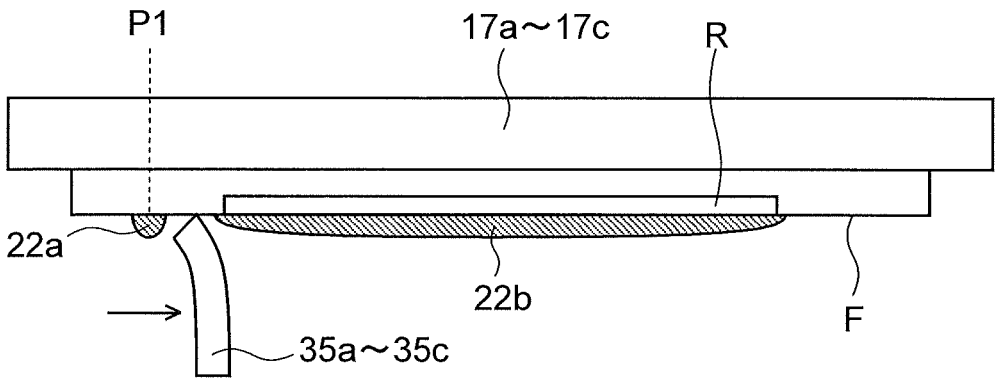
FIG. 32 is a side view of the recording heads with the wipers moved, from the state in FIG. 31, in a first direction while in pressed contact with an ink ejection surface.

With the tips of the wipers 35*a* to 35*c* in pressed contact with the ink ejection surfaces F, the controller 60 controls the drive mechanism to move the wipers 35*a* to 35*c* in the direction of the nozzle regions R (the rightward direction, a first direction) across the ink ejection surfaces F as shown in FIG. 32.

Here, as shown in FIG. 32, the residual ink 22*a*, i.e., the ink that was left at the tips (upper ends) of the wipers 35*a* to 35*c* after previous recording head recovery operation, sticks to the first positions P1 on the ink ejection surfaces F and comes off the tips of the wipers 35*a* to 35*c*. Then, before the tips of the wipers 35*a* to 35*c* enter the nozzle regions R, the controller 60 controls the drive mechanism to stop the movement of the wipers 35*a* to 35*c* in the direction indicated by arrow A.

Figure 33:
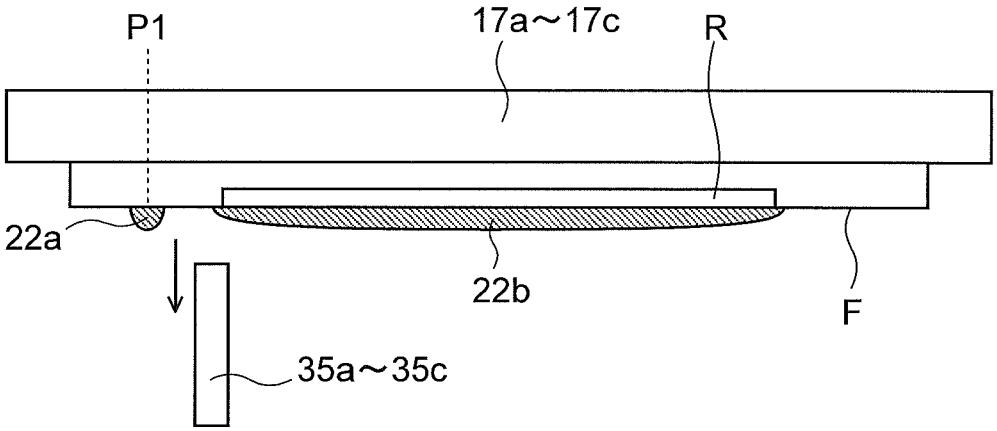
FIG. 33 is a side view of the recording heads with the wipers moved, from the state in FIG. 32, off the ink ejection surface.

Moving Step:

After the residual ink sticking step, as shown in FIG. 33, the controller 60 controls the drive mechanism to drive the ascending/descending mechanisms 50 to move the wipers 35*a* to 35*c* off the ink ejection surfaces F.

Figure 34:
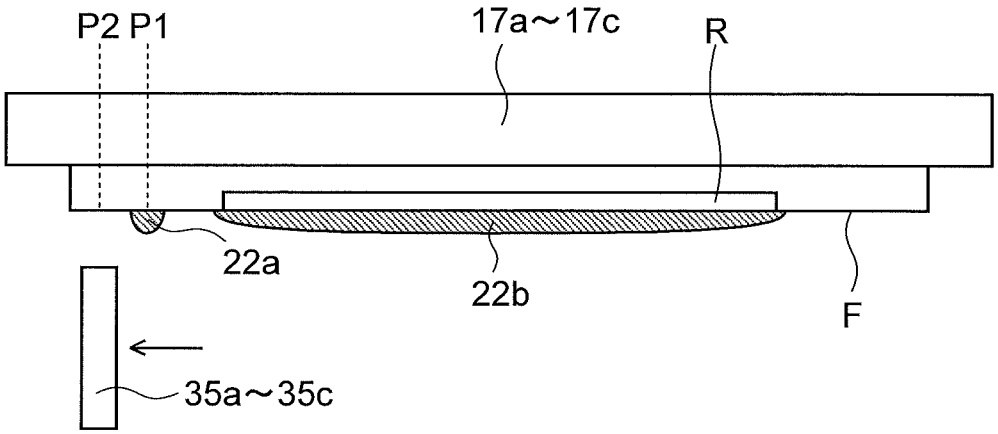
FIG. 34 is a side view of the recording heads with the wipers moved, from the state in FIG. 33, to under a second position.

Thereafter, as shown in FIG. 34, the controller 60 controls the drive mechanism to move the wipers 35*a* to 35*c* horizontally in the direction indicated by arrow A' (see FIG. 8). When the wipers 35*a* to 35*c* reach somewhere close to end parts of the ink ejection surfaces F, the leftward movement is stopped.

Figure 35:
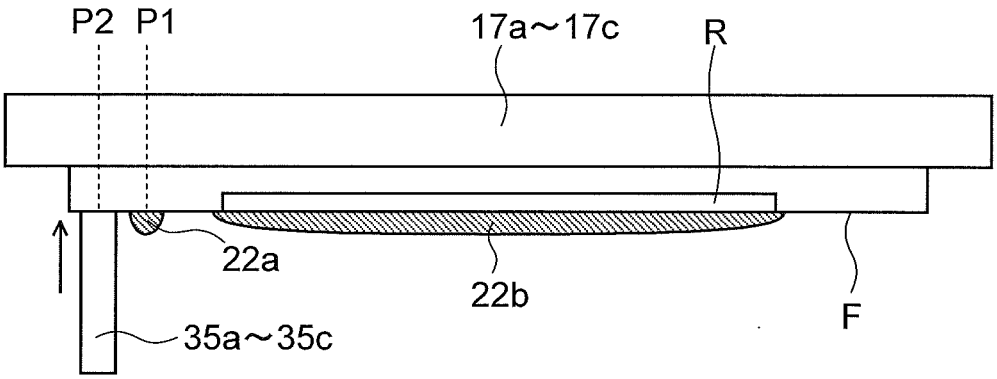
FIG. 35 is a side view of the recording heads with the wipers moved, from the state in FIG. 34, into contact with the ink ejection surface.
Figure 36A:
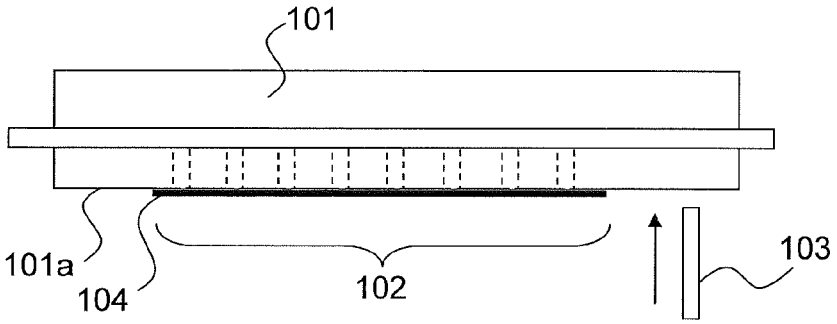
FIG. 36A is a side view of a conventional wiping mechanism which wipes a recording head's ink ejection surface with a wiper put in contact, under a predetermined contact pressure, with an ink ejection surface from a direction substantially perpendicular to it, with the wiper located under a wiping start position.
Figure 36B:
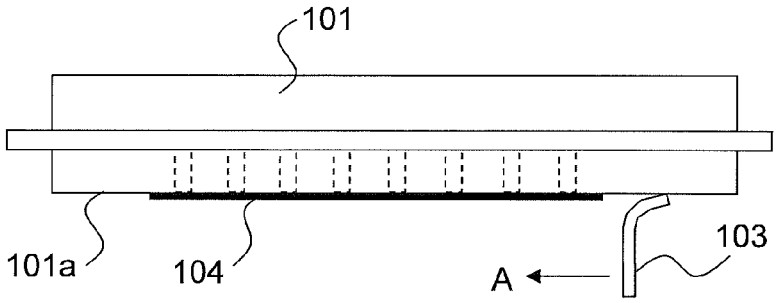
FIG. 36B is a side view of the recording head with the wiper moved, from the state shown in FIG. 36A, toward a nozzle region while in contact with the ink ejection surface.
Figure 36C:
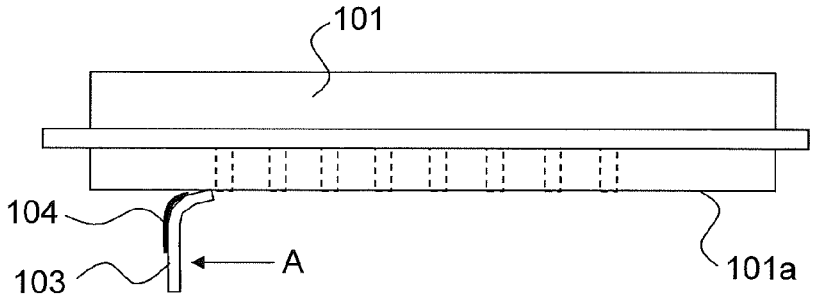
FIG. 36C is a side view of the recording head with the wiper further moved, from the state shown in FIG. 36B, past the nozzle region.
Figure 36D:
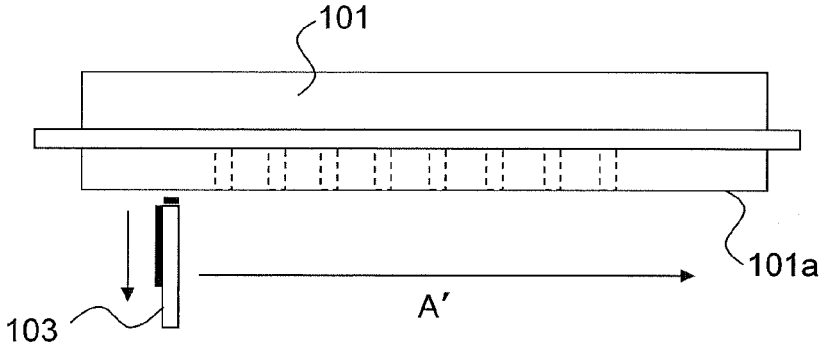
FIG. 36D is a side view of the recording head with the wiper moved, from the state shown in FIG. 36C, off the ink ejection surface.
Figure 37A:
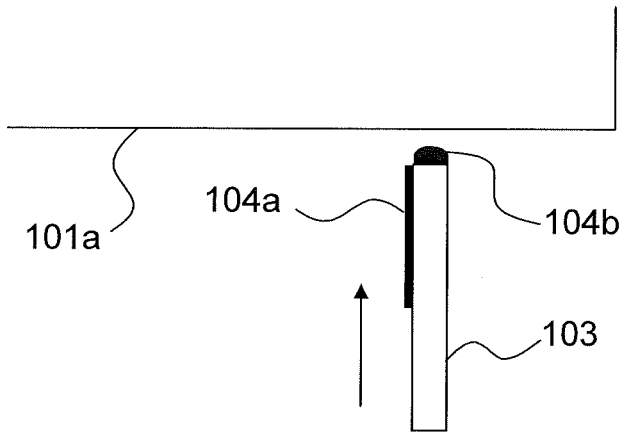
FIG. 37A is a side view of the recording head with the wiper positioned under the wiping start position prior to performing wiping for the second time by use of the conventional wiping mechanism shown in FIG. 36A.
Figure 37B:
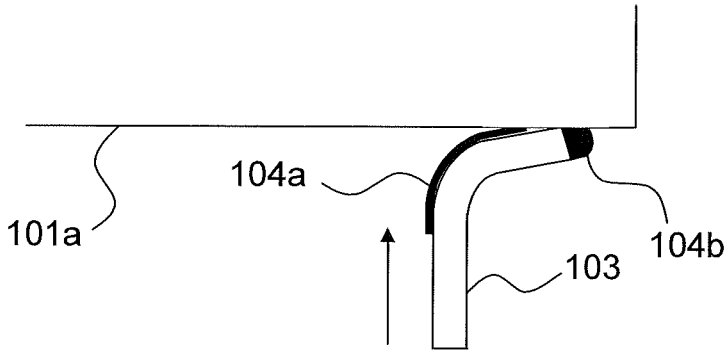
FIG. 37B is a side view of the recording head with the wiper moved, from the state shown in FIG. 37A, into contact with the ink ejection surface.
Figure 37C:
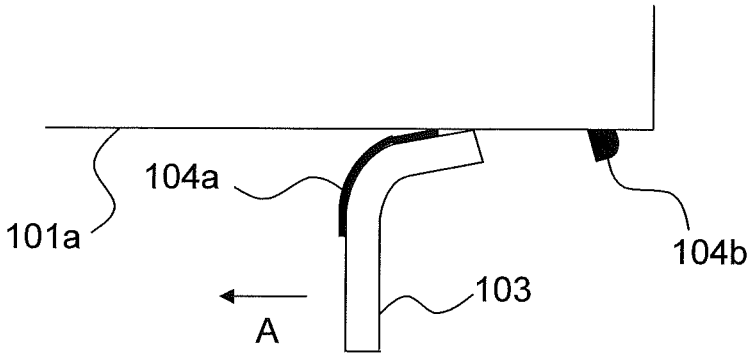
FIG. 37C is a side view of the recording head with the wiper moved, from the state shown in FIG. 37B, toward the nozzle region while in contact with the ink ejection surface.

Ink Wiping Step:

Next, the controller 60 controls the drive mechanism to drive the ascending/descending mechanisms 50 to put the wipers 35*a* to 35*c* in contact, under a predetermined pressure, with second positions P2 on the ink ejection surfaces F of the recording heads 17*a* to 17*c* as shown in FIG. 35. Then, as shown in FIG. 25, with the wipers 35*a* to 35*c* in pressed contact with the ink ejection surfaces F, the controller 60 controls the drive mechanism to move the wipers 35*a* to 35*c* in the direction of the nozzle region R (the rightward direction) across the ink ejection surfaces F. As a result, the residual ink 22*a* and the purged ink 22*b* on the ink ejection surfaces F is wiped off. The waste ink wiped off by the wipers 35*a* to 35*c* is collected in the ink collection tray 44 (see FIG. 10).

After the wipers 35*a* to 35*c* have moved to edges (the right edge in FIG. 25) of the ink ejection surfaces F of the recording heads 17*a* to 17*c* respectively, the controller 60 controls the drive mechanism to retract the wipers 35*a* to 35*c* downward from the ink ejection surfaces F of the recording heads 17*a* to 17*c* to return the maintenance unit 19 to the state shown in FIG. 16. Lastly, the controller 60 moves the maintenance unit 19 horizontally to place it under the second transport unit 12, and raises the first transport unit 5 to a predetermined position to complete the recovery operation for the recording heads 17*a* to 17*c*.

In this embodiment, as described above, prior to the residual ink sticking step, the purged ink contacting step is performed to move the wipers 35*a* to 35*c* close to the nozzle regions R to bring the residual ink 22*a* at the tips of the wipers 35*a* to 35*c* into contact with the purged ink 22*b*. By bringing the residual ink 22*a*, which has increased viscosity through prolonged exposure to the atmosphere, into contact with the purged ink 22*b*, which does not have increased viscosity, it is possible to dissolve the residual ink 22*a* and reduce its viscosity. It is then easy, in the wiping step, to wipe off the residual ink 22*a* stuck to the ink ejection surfaces F with the wipers 35*a* to 35*c*.

Moreover, as described above, in the purged ink contacting step, the residual ink 22*a* makes contact with the purged ink 22*b* without making contact with the ink ejection surfaces F. This helps prevent the residual ink 22*a* from entering and clogging the ink ejection nozzles 18.

It should be understood that the embodiments disclosed herein are all illustrative and not restrictive. The scope of the present disclosure is defined not by the description of the embodiments given above but by the appended claims, and encompasses all modifications and variations made in the sense and scope equivalent to those of the claims.

For example, although in the embodiments described, the residual ink sticking step involves moving the wipers 35*a* to 35*c* in the direction of the nozzle region R (the first direction), the wipers 35*a* to 35*c* may instead be moved in the opposite direction (the second direction). In that case, the wiping step can be performed by moving the wipers 35*a* to 35*c* in the first direction from the second positions P2 without ever being separated from the ink ejection surfaces F. With this configuration, the moving step is absorbed into the residual ink sticking step, and this helps shorten the time required for recording head recovery operation.

Although in the first embodiment described above, the ink expelling step is performed after the residual ink sticking step, it may instead be performed before, or simultaneously with, the residual ink sticking step.

Although in the embodiments described above, the drive mechanism for the carriage 31 includes the rack cogs 38, the input gear 43, and the ascending/descending mechanism 50, any other well-known drive mechanism may be used instead. The number, nozzle interval, and other specifications of the ink ejection nozzles 18 in the recording heads 17*a* to 17*c* can be set as appropriate to suit the specifications of the ink-jet recording apparatus 100. There is no particular restriction on the number of recording heads; each of the line heads 11C to 11K may be provided with one recording head, two recording heads, or four or more recording heads.

The present disclosure is applicable also to ink-jet recording apparatuses for single-color printing which are provided with only one of the line heads 11C to 11K. In that case, the recording heads 17*a* to 17*c* are provided one each; accordingly, the wipers 35*a* to 35*c* corresponding to the recording heads 17*a* to 17*c* can be fixed to the carriage 31 one each.

What is claimed is:

1. A recording head recovery mechanism for recovery of a recording head having a nozzle region in which an ejection nozzle for ejecting ink onto a recording medium has an aperture, the mechanism comprising:

a wiper configured to wipe off purged ink forcibly expelled out of the ejection nozzle and residual ink stuck at a first position on an ink ejection surface outside the nozzle region; and a drive mechanism configured to reciprocally move the wiper across the ink ejection surface which includes the nozzle region; and a controller, wherein the controller is configured to be capable of performing recovery operation for the recording head, the recovery operation comprising:

a residual ink sticking step of putting the wiper in pressed contact with the first position, and then moving the wiper, with the wiper in pressed contact with the ink ejection surface, along the ink ejection surface to let the residual ink stick to the first position;

a wiping step of, after the residual ink sticking step is performed, moving the wiper, with the wiper in pressed contact with the ink ejection surface, along the ink ejection surface from a second position, which is a position on the ink ejection surface opposite from the nozzle region with respect to the first position, in a first direction toward the nozzle region to wipe off the residual ink and the purged ink; and an ink expelling step of, before the wiper wipes off the purged ink, forcibly expelling ink out of the ejection nozzle to let the purged ink stick to the nozzle region.

2. The recording head recovery mechanism according to claim 1, wherein the recovery operation further comprises:

a purged ink contact step of, prior to the residual ink sticking step, moving the wiper close to the nozzle region and bringing the residual ink at the tip of the wiper into contact with the purged ink, and the ink expelling step is performed before the purged ink contact step.

3. The recording head recovery mechanism according to claim 2, wherein in the purged ink contact step, the residual ink makes contact with the purged ink without making contact with the ink ejection surface.

4. The recording head recovery mechanism according to claim 1, wherein the ink expelling step is performed after the residual ink sticking step.

5. The recording head recovery mechanism according to claim 1, wherein in the residual ink sticking step, the wiper is moved so as not to enter the nozzle region.

6. The recording head recovery mechanism according to claim 1, wherein in the residual ink sticking step, the wiper is moved from the first position in the first direction, and after the residual ink sticking step is performed, the wiper is moved away from the ink ejection surface, and is then moved in a second direction opposite to the first direction to a position on a side of the first position opposite from the nozzle region, and then the wiping step is performed.

7. An ink-jet recording apparatus comprising the recording head recovery mechanism according to claim 1.

8. A recording head recovery method for recovery of a recording head having a nozzle region in which an ejection nozzle for ejecting ink onto a recording medium has an aperture, the method comprising:

a residual ink sticking step of putting a wiper in pressed contact with a first position on an ink ejection surface outside the nozzle region, and then moving the wiper, with the wiper in pressed contact with the ink ejection surface, along the ink ejection surface including the nozzle region to let residual ink stick to the first position;

a wiping step of, after the residual ink sticking step is performed, moving the wiper, with the wiper in pressed contact with the ink ejection surface, along the ink ejection surface from a second position, which is a position on the ink ejection surface opposite from the nozzle region with respect to the first position, in a first direction toward the nozzle region to wipe off the residual ink and a purged ink; and an ink expelling step of, before the wiper wipes off the purged ink, forcibly expelling ink out of the ejection nozzle to let the purged ink stick to the nozzle region.

9. The recording head recovery method according to claim 8, further comprising:

a purged ink contact step of, prior to the residual ink sticking step, moving the wiper close to the nozzle region and bringing the residual ink at a tip of the wiper into contact with the purged ink, wherein the ink expelling step is performed before the purged ink contact step.

10. The recording head recovery method according to claim 9, wherein in the purged ink contact step, the residual ink makes contact with the purged ink without making contact with the ink ejection surface.

11. The recording head recovery method according to claim 8, wherein the ink expelling step is performed after the residual ink sticking step.

12. The recording head recovery method according to claim 8, wherein in the residual ink sticking step, the wiper is moved so as not to enter the nozzle region.

13. The recording head recovery method according to claim 8, wherein in the residual ink sticking step, the wiper is moved from the first position in the first direction, and after the residual ink sticking step is performed, the wiper is moved away from the ink ejection surface, and is then moved in a second direction opposite to the first direction to a position on a side of the first position opposite from the nozzle region, and then the wiping step is performed.

* * * * *